US007703159B2

(12) United States Patent
Parrilla

(10) Patent No.: US 7,703,159 B2
(45) Date of Patent: Apr. 27, 2010

(54) METHOD AND APPARATUS SUPPORTING BABIES BEING FED

(76) Inventor: Jesus Salazar Parrilla, 1019 Harding Way, Stockton, CA (US) 95208

( * ) Notice: Subject to any disclaimer, the term of this patent is extended or adjusted under 35 U.S.C. 154(b) by 0 days.

(21) Appl. No.: 12/210,332

(22) Filed: Sep. 15, 2008

(65) Prior Publication Data

US 2009/0007338 A1 Jan. 8, 2009

Related U.S. Application Data

(63) Continuation of application No. 10/832,709, filed on Apr. 26, 2004, now Pat. No. 7,454,808.

(51) Int. Cl.
*A47D 13/00* (2006.01)

(52) U.S. Cl. ..... 5/655; 5/646; 5/632

(58) Field of Classification Search ..... 5/655, 5/646, 632–633
See application file for complete search history.

(56) References Cited

U.S. PATENT DOCUMENTS

| | | | | |
|---|---|---|---|---|
| D318,969 | S | 8/1991 | Byrn | |
| 5,092,005 | A | 3/1992 | Byrn | |
| 5,154,649 | A | 10/1992 | Pender | |
| 5,261,134 | A | 11/1993 | Matthews | |
| 5,360,017 | A * | 11/1994 | Austin | 5/640 |
| 5,519,906 | A | 5/1996 | Fanto-Chan | |
| 5,551,109 | A * | 9/1996 | Tingley et al. | 5/655 |
| 5,581,833 | A * | 12/1996 | Zenoff | 5/655 |
| 5,782,244 | A * | 7/1998 | Kostich | 128/869 |
| 5,790,999 | A | 8/1998 | Clark | |
| 6,061,854 | A | 5/2000 | Crowley | |
| 6,189,169 | B1 | 2/2001 | Marcotte | |
| D443,461 | S | 6/2001 | Hall | |
| D444,981 | S | 7/2001 | Hall | |
| 6,354,665 | B1 | 3/2002 | Ross | |
| 6,484,337 | B1 | 11/2002 | Moe | |
| 6,532,612 | B2 | 3/2003 | Matthews Brown | |
| 6,564,408 | B2 | 5/2003 | Van Vuuren | |
| 6,625,828 | B2 | 9/2003 | Matthews Brown | |

(Continued)

OTHER PUBLICATIONS

"My Brest Friend Feeding Pillow", http://mybrestfriend.com/about.html Web Snapshot Oct. 9, 2004, 2 pg.

(Continued)

*Primary Examiner*—Fredrick Conley
(74) *Attorney, Agent, or Firm*—Glen L Gross

(57) ABSTRACT

A ridged base with a ridge above/adjacent to a platform zone providing surface(s) for a baby. The system preferably includes ridged base positioned over support base. Support base provides layer of flexibly firm material of depth. The ridged base may approximate any of multiple shapes. Wearer of system may chose shape optimized for them and/or best supports baby's positioning needs. The width of the baby feeding system preferably fits most nursing chairs. A separable cover attaching to a belt. Using the belt includes the belt adjustably fastened, after going around a person wearing the system. The worn version of the baby feeding system is a product of using the belt. The belt releases without tending to wake baby allowing wearer to create released baby feeding system, as a product of this process. A process choosing invention's components with commitment to pay revenue. Chosen component(s), system and revenue are process products.

21 Claims, 12 Drawing Sheets

U.S. PATENT DOCUMENTS

| | | | |
|---|---|---|---|
| 6,640,977 | B2 | 11/2003 | Matthews Brown |
| 6,651,282 | B1 | 11/2003 | Skoug |
| 6,658,681 | B2 | 12/2003 | Britto |
| 6,671,908 | B2 | 1/2004 | Brown et al. |
| 6,685,024 | B1 | 2/2004 | Matthews |
| 6,708,354 | B1 | 3/2004 | Carter |
| 6,711,770 | B1 | 3/2004 | Owens |
| 2002/0023301 | A1 | 2/2002 | Vuuren |

OTHER PUBLICATIONS

"Boppy Nursing Pillow", http://boppy.com Web Snapshot Oct. 9, 2004 1 page.

Epinion.com on My Brest Friend, http://epinions.com/content_7489556100 Jan. 29, 2001 2 pages.

Epinion.com Boppy Pillow http://www.epinions.com/kifm-review-3F77-C79BFE4-3881109F-bd1 Jan. 15, 2000 3 pages.

* cited by examiner

METHOD AND APPARATUS SUPPORTING BABIES BEING FED

CROSS REFERENCE TO RELATED APPLICATION

This continuation application claims the benefit of application Ser. No. 10/832,709, filed on Apr. 26, 2004 now U.S. Pat. No. 7,454,808, which is incorporated herein by reference in its entirety and to which priority is claimed.

BACKGROUND OF THE INVENTION

1. Field of Invention

This invention relates to support pillow or pads that can be worn around the waist to support a baby during nursing, and/or to provide support of the forearms and free up wearer's hands while engaged in an activity such as reading.

2. Description of Related Art

Breastfeeding an infant is generally beneficial for both the mother and the child. Mother's milk provides the infant with needed antibodies to build healthy defenses against germs, essential fatty acids that promote strong development of the brain and nervous system, and proteins specifically designed for infant growth. Nursing provides benefits for the mother as oxytocin, which is released in the mother's body during nursing, contracts the mother's uterus to its pre-pregnant size. The mother-infant interaction of breastfeeding also provides time for the baby to bond with his or her mother and for the mother to learn how to respond to the baby's needs.

However, as mother's and infants often nurse over 1000 times during the first three months, muscle stress can develop in the mother's arms, neck, shoulders, and back, as well as tendonitis, myofibrositis, myofascitis, and/or carpel tunnel can develop in the mother's arms. Tendonitis will refer herein to an inflammation of the tendons. Myofibrositis will refer herein to the inflammation of the perymysium. Myofascitis will refer herein to the inflammation of the thin layer of fibrous tissue known as fascia, which surrounds muscles and attaches to bones. Carpel tunnel syndrome will refer herein to conditions involving the compression of a hand's median nerve as it passes through the wrist.

Stress on the back and hands can lead to improper positioning of the infant. The improper positioning makes satiating the infant difficult. Improper position may make breast problems, such as infections, more likely to develop in the mother due to incomplete drainage of the breast.

Many mothers give up on nursing in the early weeks or months following birth, rather than after the one-year period recommended by the American Academy of Pediatrics. This decision may be in response to the physical distress discussed above, in addition to ongoing muscle fatigue that results from sleep deprivation and repetitive movements while caring for a newborn. Other factors contributing to this include but, are not limited to, mothers who have limited use of their hands due to a physical disability or pre-existing condition, and mothers who have fuller breasts, experience greater difficulties with positioning new-born babies properly at the breast.

Some pillows or pads have been designed to provide support of a nursing mother's forearms and lumbar region, in addition to the baby, and some previous devices attach directly to the wearer's waist through a waist belt or strap bringing the support pillow near the body of the wearer. Some nursing pillows elevate the infant's head higher than the infant's stomach.

However, currently available pillows or pads do not adequately support the newborn baby in a position that is in close enough proximity to the mother's nipple to make positioning of the newborn infant easy and head elevation of the infant fully optimal for feeding.

Another problem: none of the known prior pillows offer enough structural support of the baby to free up the mother's use of her hands, or to reduce apprehension of the baby rolling off the surface.

The existing pillows do not grow with the baby, but rather are designed as a single unit offering the same support to newborns, as well as to older and larger babies.

There are claims to simultaneously provide support for a baby and for the elbows, arms and hands of the feeder, easing the burden of holding the baby during feeding and freeing one or both arms for caressing the baby during feeding. However, the support offered to the baby, is inadequate. There is nothing that helps to reduce the baby's ability to roll from the surface or to hold the baby in the correct feeding position. If the mother were to remove both her hands from holding the baby, the baby could easily lose its latch from the mother's nipple and even roll from the support surface.

What is needed is an attachable device, which reduces the wearer's use of her hands while nursing. What is needed is an attachable device, which reduces the baby's ability to role from the surface. What is needed is an attachable device, which helps to support the baby's back so that the baby can be properly positioned on his or her side for nursing.

There are devices claiming to place the newborn infant in close proximity to the mother's nipple. However, newborn infants are often several inches short of reaching the mother's nipple while resting on the front support surface of these devices.

What is further needed is a support surface system that has specific features to aid with nursing newborns and that can then be modified to aid with nursing older babies and toddlers.

What is further needed is a support surface that can reduce the wearer's use of hands while reading.

What is further needed is a back support pillow with enough surface area to be positioned not only behind the lumbar area of the back but also extend support into the thoracic area of the back. Consequently, for extended periods of nursing, no additional pillow or pads would need to be inserted behind the wearer's upper-back for additional support.

What is further needed is a back support pillow, which adequately fits when mothers shift the device in order to place the baby in the football hold position.

There are devices, which describe built in elevation wedges on each end of the front surface support the baby in a feeding position. However, the front surface does not place the baby in close enough proximity to the mother's nipple making its capacity for elevating the baby's head ineffective. The inadequate elevation, size, and graduated slope built into these wedges do not adequately elevate the baby's head far enough above his or her abdomen.

Some devices have a surface described as sloping downwardly from side-to-side such that an infant supported on the midportion can be positioned with their head above their abdomen. However, it does not include a surface that supports the baby's back so that the baby can be properly positioned on his or her side for nursing. This lack of structural back support for the baby makes belly-to-belly contact between the mother and infant while nursing in the cradle-hold and cross-hold positions more difficult to achieve, and, tends to lessen the baby's ability to latch on to the mother's nipple for optimal feeding.

A big complaint about at least one prior art baby nursing system is that the hook and loop awakens baby. The inventor noticed that his wife used to put the baby down with the baby nursing system on, then go to another room and close the door to undo the hook and loop. Sometimes the baby still heard it and woke up. Women who put their babies to sleep in cribs cannot put the baby down with a baby nursing system on, so they remove it and wake up the baby.

BRIEF SUMMARY OF INVENTION

The invention includes a ridged base for a baby feeding system. The ridged base includes a ridge above and adjacent to a platform zone. The platform zone provides at least one surface on which to position a baby. The ridge tends to limit the motion of the baby and help prevent the baby from falling off the platform zone. The platform zone preferably includes an indentation for fitting a nursing mother or person wearing the baby feeding system.

The baby feeding system preferably includes the ridged base positioned over a support base. The support base approximately follows the horizontal contours of the ridged base. The support base provides a layer of flexibly firm material of a depth. The nursing mother using the baby feeding system may select the depth of the layer to optimize the systems shape for her size and activities. Women of greatly varying sizes and activities may chose components to meet their needs, greatly increasing the comfort and reducing the physical stress of repeated feedings using the baby feeding system of the invention.

One skilled in the art will realize that the ridged base may approximate a variety of shapes made from a wide variety of materials. The ridged base may preferably approximate any of the following shapes: a semi-oval, a semi-circle, a semi-rectangle, a rectangle, a semi-square with extended sides, a donut, a molar and/or a horseshoe shape. The wearer of the baby feeding system may chose a shape which optimizes for their size and best supports their baby's positioning needs when nursing. The horseshoe shape has an additional adaptation for nursing twins.

The width of the baby feeding system is preferably between 15 to 21 inches. The width may further be between 18 to 21 inches. These systems fit most nursing chairs, which are between 17 to 23 inches in width. In some situations, as when feeding twins, the width of the baby feeding system may exceed 21 inches, possibly less than 36 inches. The width may further be greater than 14 inches.

The invention includes a baby feeding system with a separable cover attaching to a belt. The belt has two ends, a first end and a second end. The first end includes a hook and loop strip for coupling to a hook and loop zone on the separable cover. The second end includes a first quiet clip component to attach to at least one of a second quiet clip component. The second, quiet clip components are affixed to the separable cover.

As used herein, a hook and loop strip attaches to a hook and loop zone to flexible bind the two together. An example of hook and loop strips and zones can be found in the commonly available VELCRO™ products.

The invention also includes a belt for use with baby feeding systems. The belt includes a first end and a second end. The first end includes a first hook and loop zone. The second end includes a first quiet clip component. The belt is used with a baby feeding system including a second hook and loop zone and at least one second, quiet clip component.

The method of using the belt includes the following. The belt is adjustably fastened by the first hook and loop zone coupling with the second hook and loop zone, after going around a person wearing the system. The belt is fastened by the first quiet clip component attaching to the second quiet clip component. These steps are typically performed when a baby is about to nurse and awake. A worn version of the baby feeding system is the product of the use of the belt.

When the baby has fed and drifted into sleep, the belt is further used to release the first and second quiet clip components without tending to wake the baby. This allows the person wearing the system to remove it and create a release baby feeding system. The released baby feeding system is a product of this process. It has the advantage of not disturbing the baby's sleep when created.

The baby feeding system further preferably includes a separable cover. The separable cover includes a removal zipper located below the covered unit for holding the baby. When the covered unit includes an attached closure arm, the removal zipper preferably extends about at least N percent of the outside perimeter of the covered unit. N is at least 90 percent. When the covered unit does not includes an attached closure arm, and the zipper starts near one of the two fasteners, the removal zipper extends at least M percent of the outside perimeter of the covered unit. M is at least 75 percent. The separable cover has the advantage of being easy to remove and replace, which eases the task of cleanup. Cleanup tasks are one of the major chores of baby care.

The invention includes a collection of back supports of varying sizes and shapes. Some of the sizes relieve back pain for smaller women. Some of the sizes relieve back pain for petite women. The back supports preferably include a pocket through which the belt may pass.

The belt may be inserted through the pocket of a back support. The belt may then create a worn version of the baby feeding system with a selectable back support. The worn version of the baby feeding system with the selectable back support is a product of this process.

The pocket preferably faces away from the wearer when used with the belt. The belt may further include a second, quiet clip component situated near the first end of the belt. The belt and back support provide a portable back support attached by the belt to the wearer.

The baby feeding system may also provide a portable shelf with a ridge upon which adult items may be placed. Adult items may include, but are not limited to, a book, cosmetics, a personal digital assistant or notebook computer. The ridge limits the opportunities for adult items to fall off of the portable shelf.

The ridged base may also be made with an attached back support arm, instead of using the belt.

The ridged base may preferably be removed from the support base, leaving an open, semicircle surface.

The invention includes a business method based upon a wearer, their associated and/or agent selecting components based upon the invention to create a baby feeding system upon committing to pay revenue. The chosen component(s) and/or chosen baby feeding system are products of the business method, as is the revenue.

DETAILED DESCRIPTION OF INVENTION

Table of Reference Numbers

| Number | Description | FIGS. |
|---|---|---|
| 2 | baby or toddler | 1A, 1B |
| 6 | wearer, often nursing mother | 1A, 9A to 9D |
| 10 | ridged base | 1A to 5B, 9B, 11A to 12A |
| 12 | platform zone | 1B to 5B, 12A, 12B |
| 12A, 12B | platform insert | 5A, 5B |
| 14 | ridge | 1A to 4B, 8A, 9B, 12A, 12B |
| 14A to 14C | ridges | 5A, 5B |
| 16 | contour for wearer's waist | 2A to 3A, 4A to 5B, 11A, 11C to 12A |
| 18 | horizontal contour of ridged base 10 | 3B |
| 20 | support base matching the horizontal contour 18 | 3B, 7C to 7E, 8B, 9A, 9C, 11A to 11F |
| 20A | support base medium firm layer | 7C to 7E |
| 20B | support base flexibly firm layer | 7C to 7E |
| 30 | covered unit | 1A to 5B, 8A, 8B, 11A to 12A |
| 32 | depth of support | 3A, 3B, 4B, 5A, 7C to 7E |
| 34 | outside perimeter of covered unit 30 | 4A |
| 36 | removal zipper of separable cover 50 | 4A |
| 38 | joint side of the outside perimeter | 4A |
| 50 | separable cover for covered unit 30 | 1A to 2B, 4A, 5A, 8A to 8E, 9B, 11A to 11F |
| 52 | fastener on a first end of the separable cover 50 | 2B, 8B, 11A to 11F |
| 54 | fastener on a second end of the separable cover 50 | 1A, 2A, 11A to 11F |
| 56A to 56C | pole holders | 12A, 12B |
| 60A | ridge insert | 5B |
| 62, 64 | first and second poles | 12A, 12B |
| 70 | belt | 1A to 3A, 5A, 6A to 6C, 7A, 7B, 8B, 9A, 9C, 9D |

-continued

Table of Reference Numbers

Figure 4A:
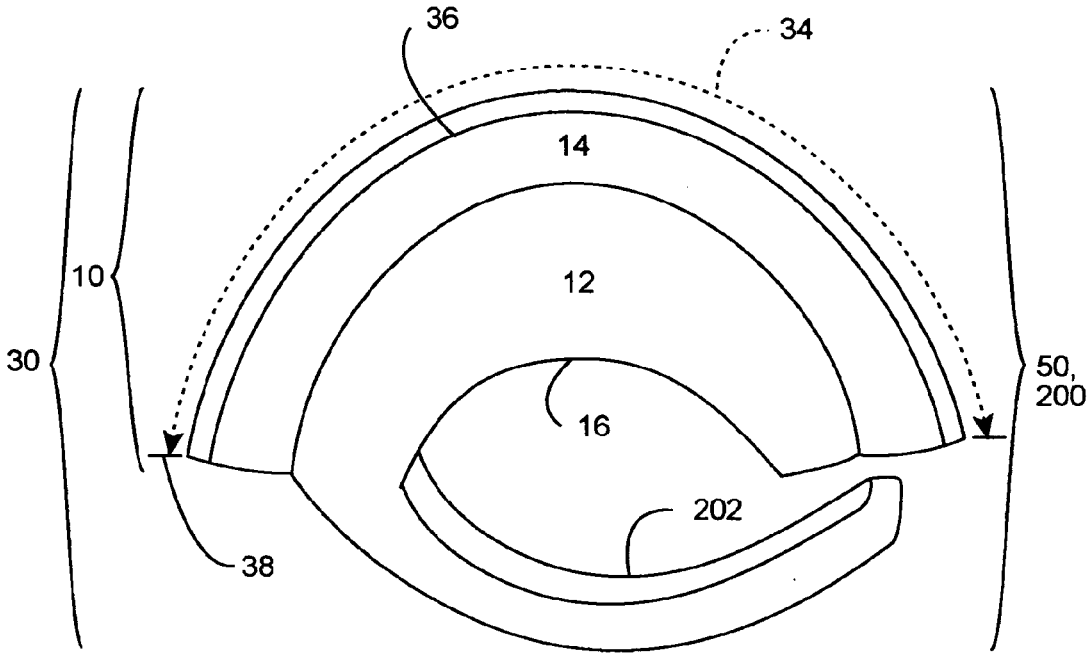
FIG. 4A shows a top view an embodiment of the baby feeding system including the ridged base with an attached closure arm, collectively covered by a separable cover with removal zipper located below the covered unit for holding the baby.
Figure 4B:
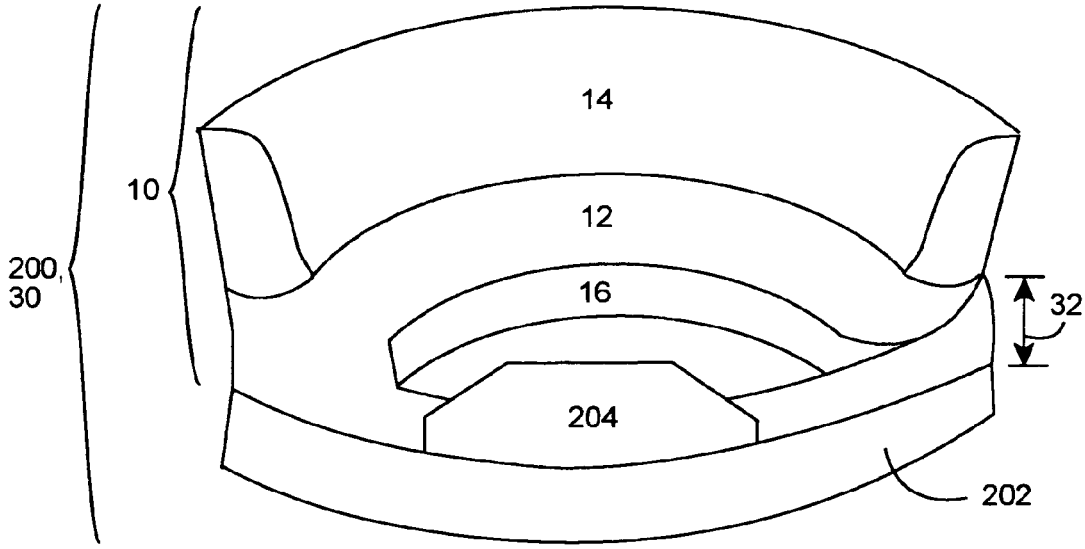
FIG. 4B shows a front view an embodiment of the baby feeding system of FIG. 4A where the attached closure arm includes a back support.
Figure 8A:
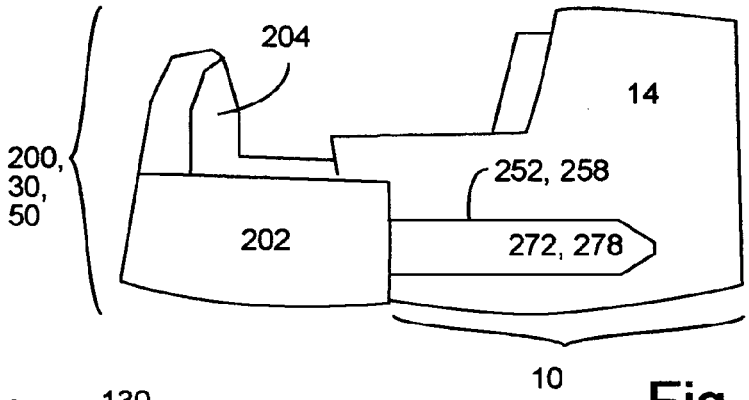
FIG. 8A shows a detail of the attached closure arm of the baby feeding system of FIG. 4B.
Figure 8B:
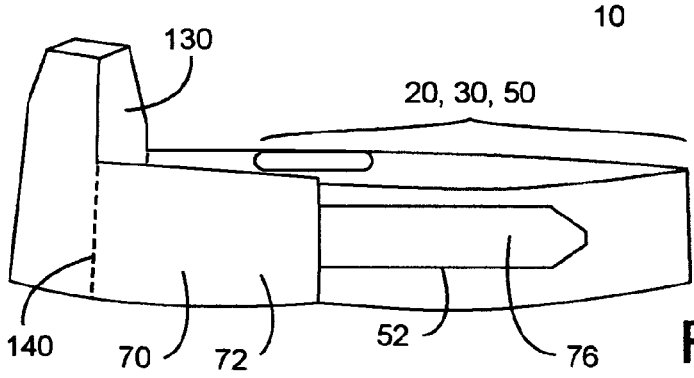
FIG. 8B shows the belt with the back support attached to a separable cover covering the support base, collectively found in FIGS. 1A to 3B, 5A, and 6A to 7C.

| Number | Description | FIGS. |
|---|---|---|
| 72 | first end of the belt | 2B, 6A to 6C, 8B |
| 74 | second end of the belt | 1A, 2A, 6A to 6C |
| 76 | hook and loop strip | 6A to 6C, 8B |
| 77, 79 | beveled edges of belt 70 | 2A, 6A, 6B |
| 78 | first quiet clip component | 2A, 6A to 6C, 8B |
| 80 | second quiet clip component | 1A, 2A, 6A to 6C |
| 82 | attachable belt end | 6A, 6C |
| 84 | matched attachment strip of belt end | 6A, 6C |
| 100 | baby feeding system | 1A, 2A to 3A, 5A |
| 102 | released baby feeding system | 1B |
| 130 | back support | 1A, 2A to 3A, 5A, 6C, 8B, 9A, 9C, 9D |
| 130-A to 130-C | back supports of a first second and third size and a first shape | 7A, 7B |
| 130-D | back support of a second shape | 7A, 7B |
| 130-E | back support of a third shape | 7A, 7B |
| 140 | pocket included in back support 130 for belt 70 | 8B, 9A |
| 150 | wedge shaped pillow | 1B to 2B |
| 170 | adult item | 9B |
| 200 | baby feeding system with attachable arm | 4A, 4B, 8A |
| 202 | ridged base with attached arm | 4A, 4B, 8A, 8C to 8E |
| 204 | back support for ridged base with attached arm | 4B, 8A |
| 252 | first quiet clip of separable cover 50 for covered unit with attached closure arm | 8A, 8D, 8E |
| 258 | first hook and loop zone of separable cover 50 for covered unit with attached closure arm | 8A, 8C |
| 272 | second quiet clip component for attaching to 252 | 8Z, 8D, 8E |
| 278 | second hook and loop strip of separable cover 50 | 8A, 8C |
| 500 | ridged base list | 10 |
| 502 | version of the ridged base 10 | 10 |
| 504 | version of the multi-ridged base | 10 |
| 506 | version of ridged base with a second width | 10 |
| 508 | version of a ridged base 10 with width an attached arm 200 | 10 |
| 510 | support base list | 10 |
| 512 | version of a support base 20 of a first depth | 10 |
| 514 | version of a support base 20 of a second depth | 10 |
| 516 | version of a support base 20 for a second contour | 10 |
| 518 | version of a support base 20 in a ridged base 10 | 10 |
| 520 | back support list | 10 |
| 522 | version of a back support 130 of a first size | 10 |
| 524 | version of a back support 130 of a second size | 10 |
| 526 | version of a back support 130 of a first shape | 10 |
| 528 | version of a back support of a second shape | 10 |
| 530 | belt list | 10 |
| 532 | version of the belt 70 of a first length | 10 |
| 534 | version of the belt of a second length | 10 |
| 536 | version of the belt with a first option for at least one belt ends | 10 |
| 538 | version of a belt with a second option for at least one of the belt ends | 10 |
| 550 | separable cover list | 10 |
| 552 | version of a separable cover 50 for a covered unit 30 including a ridged base 10 and maybe support base 20 | 10 |
| 554 | version of a separable cover 50 for covered unit 30 including just a support base 20 as shown in FIG. 8B | 10 |
| 556 | version of a separable cover for covered unit 30 including just a ridged base 10 with an attached arm 202 as in FIGS. 4A and 4B | 10 |
| 558 | version of a separable cover for a back support 130 | 10 |
| 560 | version of the separable cover 50 made from flame retardant cotton | 10 |
| 562 | version of the separable cover 50 made from a non-PBDE cotton | 10 |
| 564 | version of the separable cover 50 made from vinyl | 10 |
| 570 | system implementing the business method | 10 |
| 580 | chosen ridged base, based on ridged base list 500 | 10 |
| 582 | chosen support base, based on support base list 510 | 10 |
| 584 | chosen back support, based on back support list 520 | 10 |
| 586 | chosen belt, based upon the belt list 530 | 10 |
| 588 | chosen separable cover, based on separable cover list 550 | 10 |
| 590 | chosen baby feeding system | 10 |
| 600 | revenue | 10 |
| 602 | wearer or associate of wearer 6 commits revenue | 10 |
| 604 | payment for chosen items | 10 |
| 608 | system interacts with wearer 6 or associate | 10 |

-continued

Table of Reference Numbers

| Number | Description | FIGS. |
|---|---|---|
| 610 | use chosen baby feeding system 590 | 10 |
| 612 | delivery of at least one element of the chosen baby feeding system | 10 |

As used herein, a covered unit 30 for a baby feeding system 100 and/or 200, may include, but is not limited to, the following. The ridged base 200 with attached arm 202 as shown in FIGS. 4A, 4B and 8A. The ridged base 10 over a support base 20 supporting or shown in FIGS. 1A to 3B, 5A, and 5B. The support base 20, supporting or shown in FIGS. 8B, 9A, and 9C.

The invention includes a ridged base 10 for a baby feeding system 100 and/or 200. The ridged base 10 includes a ridge 14 above and adjacent to a platform zone 12. The platform 12 provides at least one surface on which to position a baby 2. The ridge 14 tends to limit the motion of the baby 2 and help prevent the baby 2 from falling off the platform zone 12 preferably includes an indentation 16 for fitting a nursing mother or person 6 wearing the baby feeding system 100 and/or 200.

Since a newborn baby 2 may be fed over a dozen times a day, these support characteristics are beneficial in avoiding or minimizing repetitive stress injuries, as well as tendonitis in the wrists and forearms of the feeder. Since the baby feeding system according to the invention eases the feeder's muscle strain, the nursing mother will likely feed the baby for a longer period of time, in terms of the duration of feedings, as well in terms of the number of months, than in one of the prior pillows was used. As discussed earlier, this provides benefits both to the mother and the baby by helping the nursing breastfeed successfully in the early weeks and months following birth.

This support of the baby, in turn, truly minimizes the mother's use of her hands, thereby reducing the chances of repetitive stress injury, tendonitis, and muscle fatigue experienced in the fingers, wrists, arms, shoulders, and neck.

Support of the feeder's forearms, as well as freeing up the feeder's hands from having to hold the baby at all times, reduces muscle stress, in particular stress of the trapezius muscles. The support is useful for bottle-feeders to help support the extended arm that holds the bottle while freeing up the use of the other arm. The support pillow according to the invention is as necessary while supporting the baby in a manner that minimizes use of the feeder's arm.

The ridged base 10 and/or the support base 20 may preferably be spot cleaned. A damp cloth may be used to clean foam.

In certain embodiments the ridged base 10 and/or the support base 20 may be made of foam that does not contain a flame retardant known as PBDEs, which refer to polybrominated diphenyl ethers. There is reason to believe that this flame retardant is a major pollutant. PBDE is believed to show up in blood/tissue tests on humans. Additionally, some babies have allergic reactions to PBDEs. Alternatively the ridged base 10 and/or the support base 20 may include PBDEs, due to current laws regarding flammability and foam. The ridged base 10 and/or support base 20 could also be made out of latex foam or inflatable (vinyl) or any other type of flexible material, or a combination of the above materials. The ridged base 10 and/or the support base 20 can also be made of other stronger, flexibly firmer materials such as Styrofoam or polystyrene. One skilled in the art will recognize that the ridged base 10 and/or the support base can be made of conventional foam, memory foam, tempurepedic foam, close cell foam, polyfiberfill, polyester fiber and similar materials.

The invention includes a ridged base 10 for a baby feeding system 100. The ridged base 10 includes a ridge 14 above and adjacent to a platform zone 12. The platform zone 12 provides at least one surface on which to position a baby 2. The ridge 14 tends to limit the motion of the baby 2 and help prevent the baby 2 from falling off the platform zone 12. The platform zone 12 preferably includes an indentation 16 for fitting a nursing mother 6 or person wearing the baby feeding system 100.

The invention features a ridge 14 to position a newborn 2 properly at the nipple of the mother 6 and to free up the mother's hands. The invention includes leaving a support base to support an older baby 2 during nursing. The ridge 14 may be attachable.

The baby feeding system 100 has a shape and construction that places and helps to hold the nursing infant 2 in close proximity to the nipple of the mother 6.

The ridged base 10 can be made with either two types of foam: A flexibly firm form with a density between 2.40 and about 2.55 with an ILD of 70.80. A medium firm form with 31/37. The flexibly firm foam preferably makes the ridged base 10 strong to support the baby. Purpose of medium firm foam is to create a comfortable surface for the baby on the top support pillow.

The opening on the first and second side portions of the attachable upper pillow, however, provide ample space for the nursing mother to pick up and reposition the baby on the opposite breast. These openings also allow space for growth room as the newborn grows in size, as well as wiggle room so that the baby can move, wiggle, and stretch while nursing.

The baby feeding system 100 and/or 200 preferably includes the ridged base 10 positioned over a support base 20. The support base 20 approximately follows the horizontal contours 18 of the ridged base 10. The support base 20 provides a layer 20B of flexibly firm material of a depth 32. The nursing mother 6 using the baby feeding system may select the depth 32 of the layer 20B to optimize the shape of the system for her size and activities. Women of greatly varying sizes and activities may adapt the system to their needs, greatly increasing the comfort and reducing the physical stress of repeated feedings.

Figure 7A:
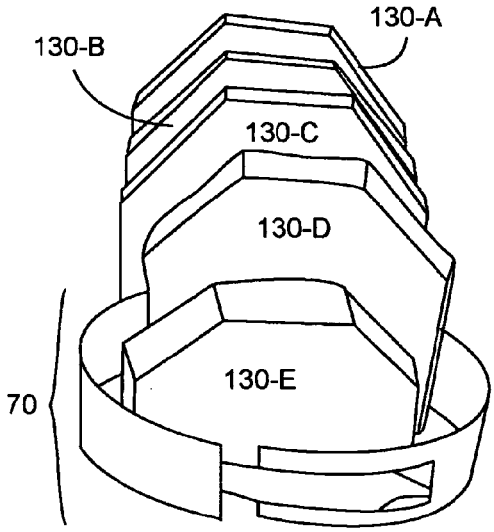
FIGS. 7A and 7B show two views of embodiments of the back support of FIGS. 1A, 2A, 2B, 3A, 5A and 6C, with multiple sizes and shapes.
Figure 7C:
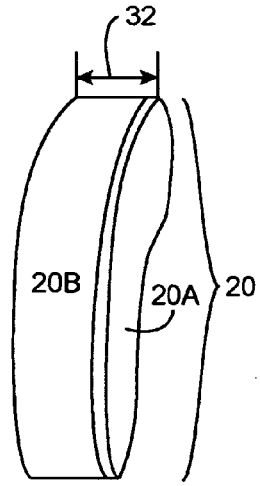
FIG. 7C, 7D and 7E show the support base of FIG. 3B with multiple depths and at least one embodiment with multiple layers of foam.
Figure 7D:
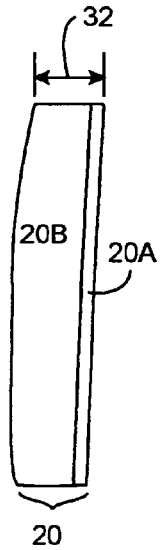
Figure 7B:
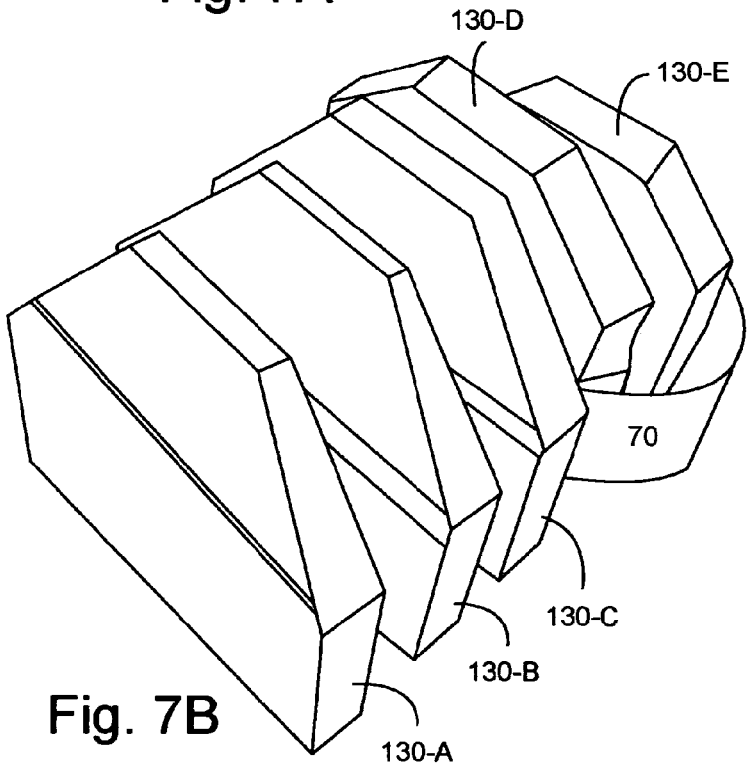
Figure 7E:
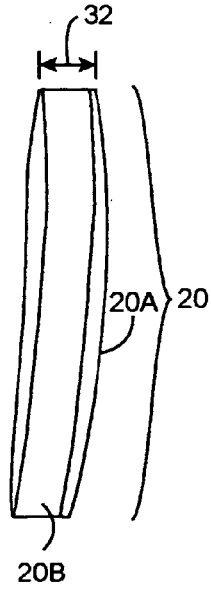

The support base 20 may preferably have a depth 32 between 3 to 6 inches as shown in FIGS. 3A, 4B, and 7C to 7E. The support base 20 may include a layer 20B of the flexibly firm foam. The flexibly firm layer 20B may be between 2 and 4 inches depth. The support base 20 may further preferably include a layer 20A of the medium firm foam. The medium firm layer 20A may preferably have a depth between 0.5 inches and 1.5 inches. FIGS. 7C to 7E show support bases 20 of varying depths 32.

That the support base 20 comes in depths 32 to accommodate different sized nursing mother and other wearers. One depth does not fit all. By way of example, a first nursing mother approximately four feet ten inches in height, and a second nursing mother of five feet ten inches in height will tend to need differing depths 32 in the support base 20. The flexibility in depths 32 of the baby feeding system 100 and/or 200 tends to help mothers 6 to better position their babies 2 to nurse more successfully.

The covered unit 30 including the ridged base 10 and the support base 20 may preferably use two types of foam. A flexibly firm foam with a 2.40-2.55 Density –70.80 ILD. And a medium firm (31/37). The flexibly firm foam preferably makes the baby feeding system 100 or 200 strong to adequately support the baby 2. The medium firm foam preferably creates a comfortable surface for the baby 2. That surface may preferably includes the platform zone 12 as well as at least those portions of the ridge 14 the baby is likely to touch.

The medium firm foam may be preferably placed on the support base. When the ridged base 10 is removed from the baby feeding system 100, such as when the baby 2 outgrows the ridged base 10, the support base 20 can provide the baby 2 with a comfortable surface on which to nurse.

The baby feeding system 100 or 200 preferably includes a covered unit 30 with the ridged base 10 positioned over a support base 20. The support base 20 approximately follows the horizontal contours 18 of the ridged base 10. The support base 20 provides a layer of flexibly firm material of a depth 32. The nursing mother 6 using the baby feeding system 100 or 200 may select the depth 32 of the layer to optimize the systems shape for her size and activities. Women of greatly varying sizes and activities may adapt the baby feeding system 100 to their needs, greatly increasing the comfort and reducing the physical stress of repeated feedings.

Both the support base 20 and the ridged base 10 can be worn around the waist of the wearer 6. They can be adjusted to accommodate people of different sizes or enclose a particular wearer more or less tightly. The support base 20 and the ridged base 10 are shaped in a semi-circle 16 that fits closely to the waist.

Figure 3A:
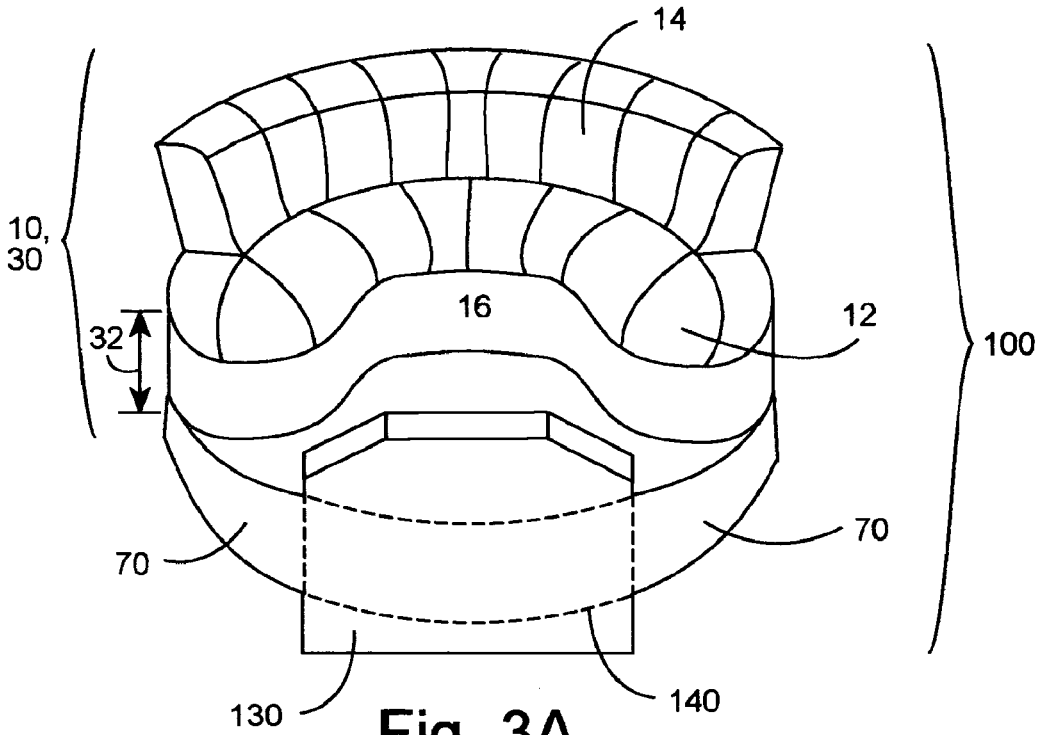
FIG. 3A shows a front view of the baby feeding system of FIGS. 1A to 2B.
Figure 3B:
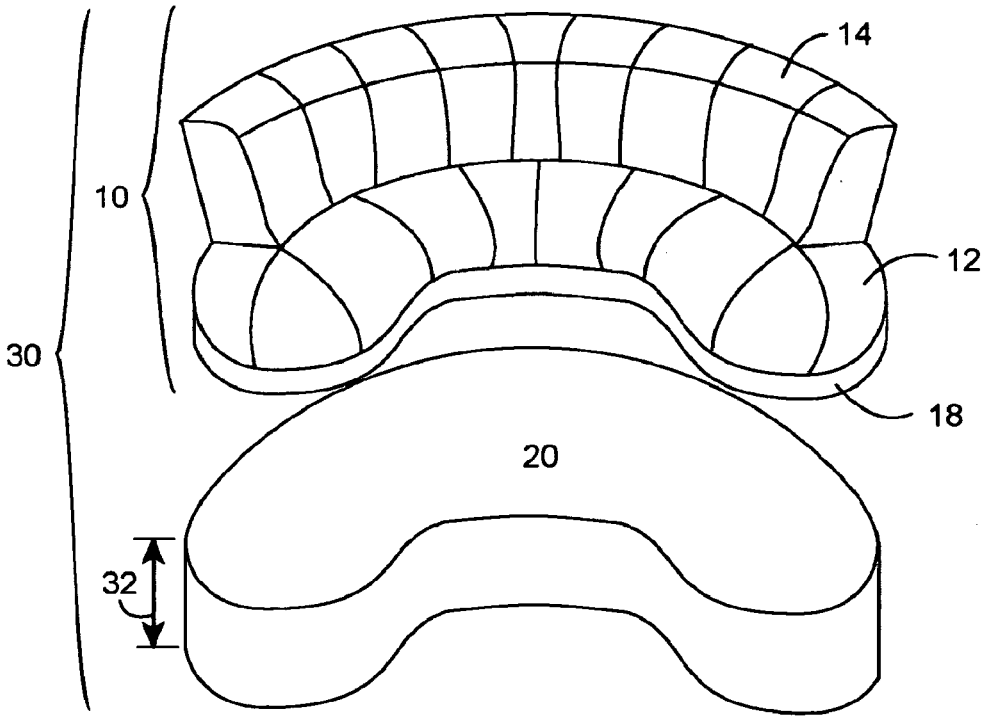
FIG. 3B shows an embodiment of the covered unit of FIGS. 1A to 3A, including a ridged base and support base.

FIG. 3B shows an embodiment of the covered unit 30 of FIGS. 1A to 3A, including a ridged base 10 and a support base 20.

Figure 1A:
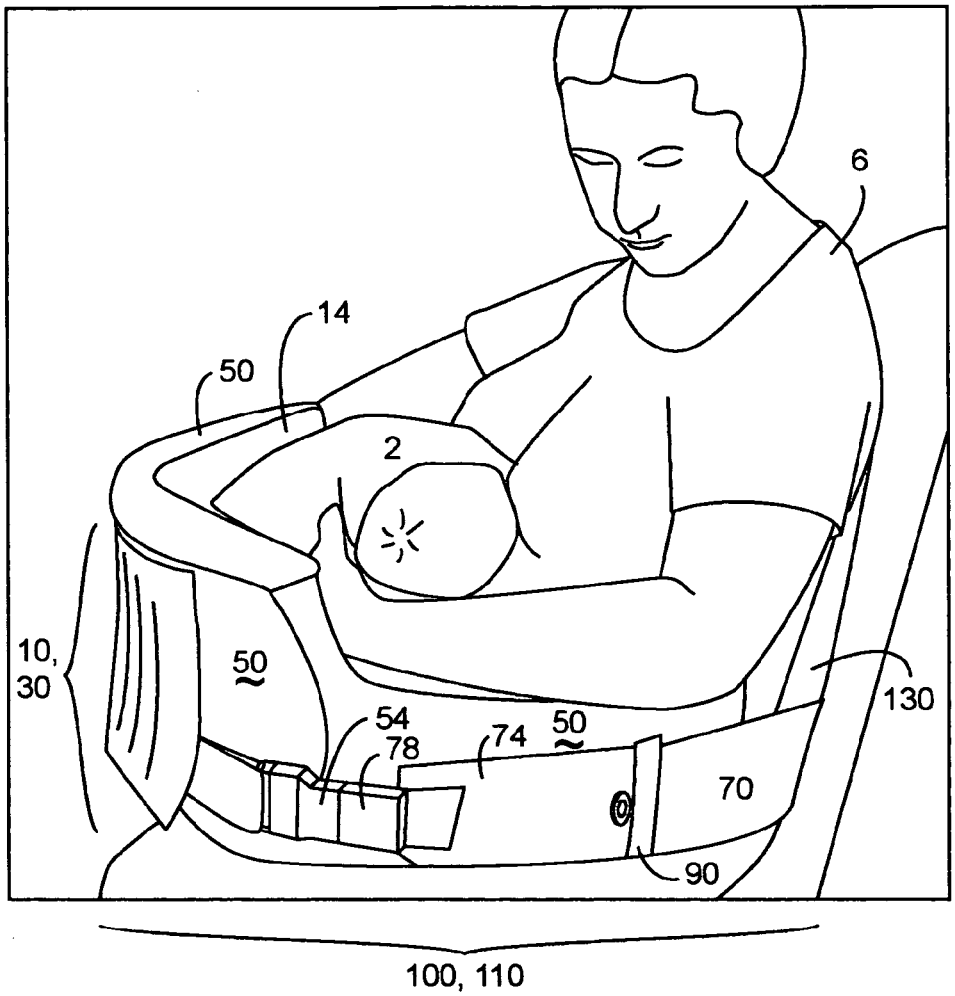
FIG. 1A shows a baby feeding system being used by a wearer to nurse a baby, in accord with the invention.
Figure 9A:
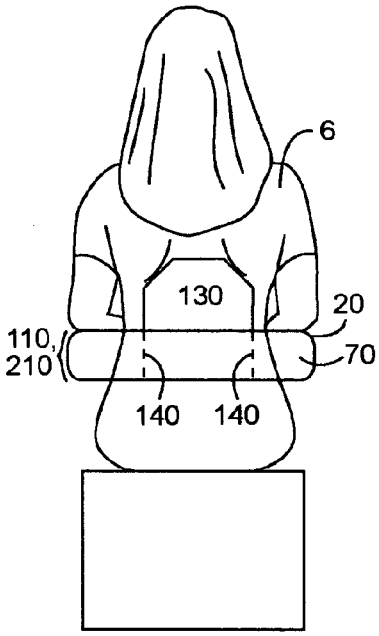
FIG. 9A shows the back view of the baby feeding system with the belt and the back support collectively found in FIGS. 1A to 3A, 6A to 7B, and 8B, used by a wearer to support their arms.
Figure 9B:
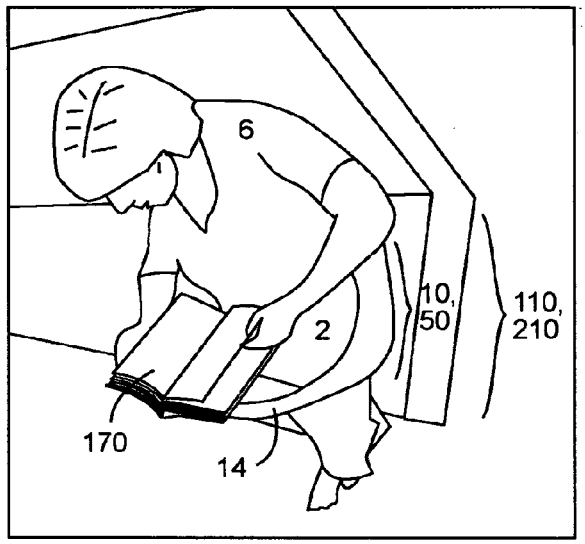
FIG. 9B shows a perspective view of the wearer using the baby feeding system of FIGS. 1A to 3A, and 4A to 5B, to at least partly hold an adult item, such as a book.
Figure 9C:
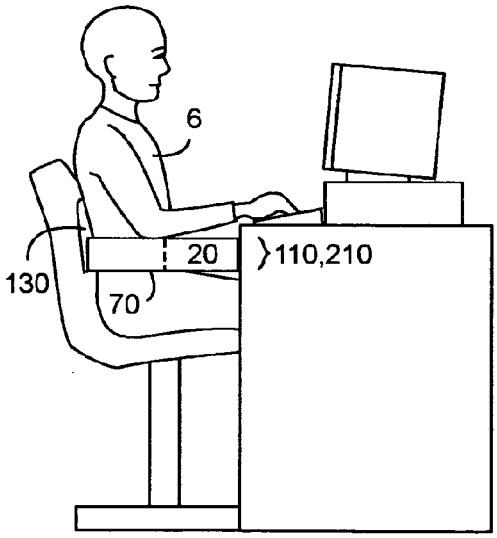
FIG. 9C shows the wearer using the support base with a separable cover, coupled with a belt holding the back support, collectively found in FIGS. 6A to 7B, 8B to 8E and 9A.

The ridged base 10 and/or support base 20 preferably fit across the abdominal area of the wearer 6 as shown in FIGS. 1A, 9B and 9C. The ridged base 10 and/or support base 20 may further preferably fit along the side of the wearer 6.

The support base forms a semicircle against the body, while the ridged base 10 raises and places the infant 2 near the nipple of the mother 6. The ridged base10 also forms a semicircle 16 and has a graduated thickness from front to back in the platform zone 12. The ridge 14 includes a walled border surface, which is extended about two-thirds of the semi-circle base, and forms a curved slope for at least most of the length of the wall. The ridge 14 aids in holding the infant 2, or object 170, flexibly firmly near the body of the wearer 6.

Because of the overall configuration of the baby feeding system 100, the support base 20 and the ridged base 10 tend to remain securely and stably in place when the wearer 6 moves between a sitting and standing position or walks around.

The openings on the side portions of the ridge 14 are sized and constructed to support the elbows and forearms of the wearer 6 in a natural position. The ridged base 10 and the support base 20 are made of flexibly firm, resilient, yet lightweight, material that can help to hold objects in place, but that can also be easily lifted by the wearer 6. The baby feeding system 100 does not become too heavy when the wearer 6 wears it for an extended period of time.

FIG. 7C shows the support base 20 of FIG. 3B with multiple depths and at least one embodiment with multiple layers of foam.

Figure 5A:
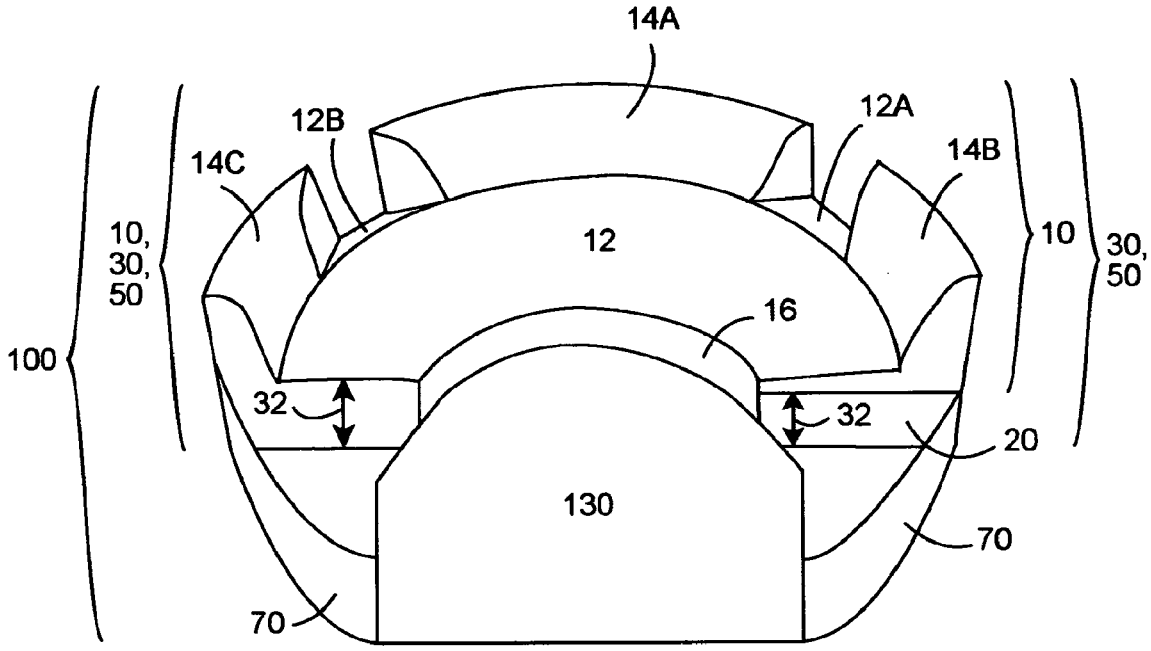
FIG. 5A shows a baby feeding system including a refinement of the covered unit including a refinement to the ridged base of FIGS. 1A to 3B, including multiple ridges and a platform zone which includes multiple platform inserts.
Figure 5B:
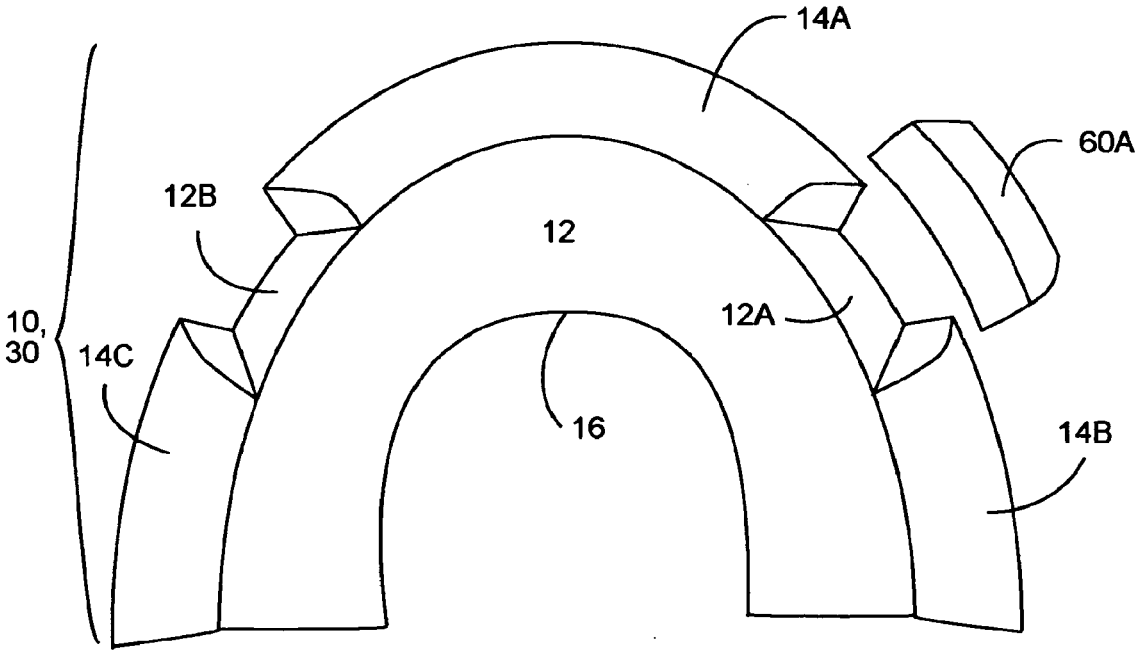
FIG. 5B shows a top view of the ridged base of FIG. 5A with a ridge insert capable of insertion into at least one of the platform inserts.

One skilled in the art will recognize that the ridged base 10 may approximate a wide variety of shapes. The ridged base 10 may preferably approximate any of the following shapes: a semi-oval with rounded ends (FIGS. 3A and 3B), a semicircle (FIGS. 4A and 4B), and/or a horseshoe shape (FIGS. 5A and 5B). The wearer 6 of the baby feeding system 100 may chose a shape which optimizes for their size and best support their baby's or babies' positioning needs when nursing. The horseshoe shape has an additional adaptation for nursing twins.

Figure 11A:
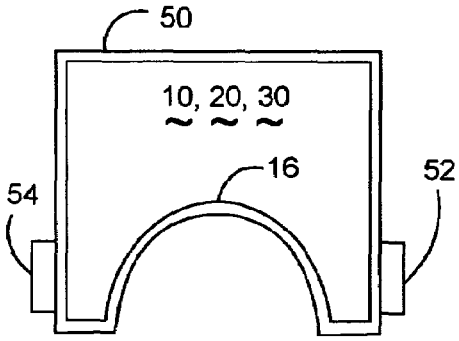
FIG. 11A shows the ridged base, and/or the support base, and/or the cover unit with a semi-square shape.
Figure 11B:
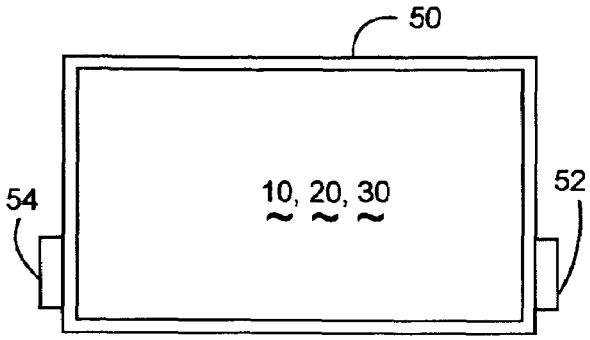
FIG. 11B shows the ridged base, and/or the support base, and/or the cover unit with a rectangle shape.

By way of example, the ridged base 10, and/or the support base 20, and/or the covered unit 30 may be seen through its horizontal contour to embody at least any of the shapes shown in FIGS. 11A to 11F. In each of these Figures, the separable cover 50 may include a first fastener 52 and a second fastener 54 as discussed in other Figures. In FIGS. 11A, and 11C to 11F, the horizontal contour of the ridged base 10, support base 20 and covered unit 30 are shown with a contour 16 to fit the waist of the wearer 6. In FIG. 11B, the horizontal contour of the ridged base 10, support base 20 and covered unit 30 is shown without such a contour.

FIG. 11A shows the ridged base 10, and/or the support base 20, and/or the covered unit 30 with a semi-square shape.

FIG. 11B shows the ridged base 10, and/or the support base 20, and/or the covered unit 30 with a rectangle shape.

Figure 11C:
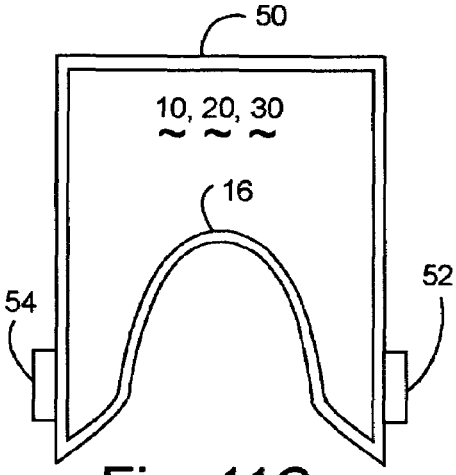
FIG. 11C shows the ridged base, and/or the support base, and/or the cover unit with a semi-square with extended sides shape.

FIG. 11C shows the ridged base 10, and/or the support base 20, and/or the covered unit 30 with a semi-square with extended sides shape.

Figure 11D:
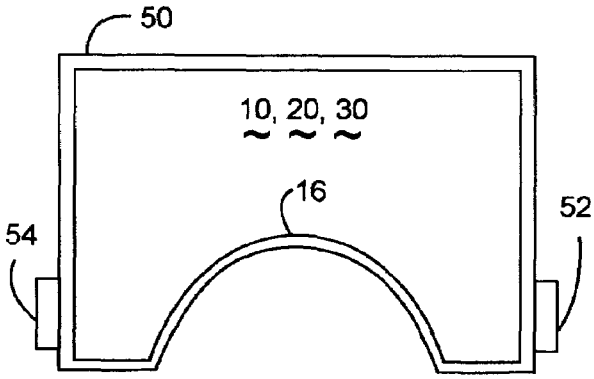
FIG. 11D shows the ridged base, and/or the support base, and/or the cover unit with a semi-rectangle shape.

FIG. 11D shows the ridged base 10, and/or the support base 20, and/or the covered unit 30 with a semi-rectangle shape.

Figure 11E:
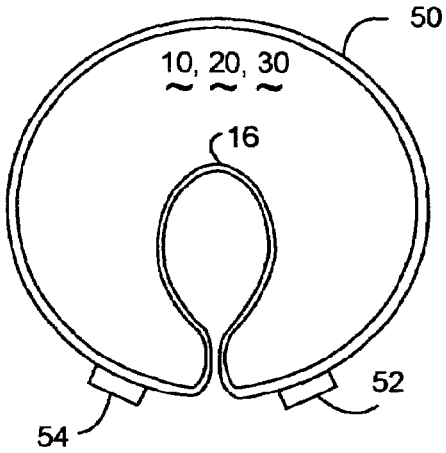
FIG. 11E shows the ridged base, and/or the support base, and/or the cover unit with a donut shape.

FIG. 11E shows the ridged base 10, and/or the support base 20, and/or the covered unit 30 with a donut shape.

Figure 11F:
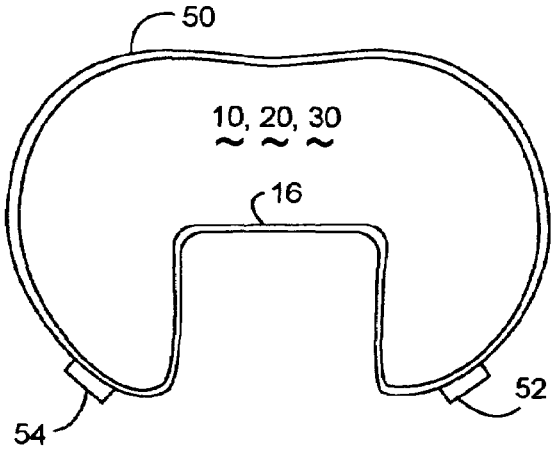
FIG. 11F shows the ridged base, and/or the support base, and/or the cover unit with a molar shape.

FIG. 11F shows the ridged base 10, and/or the support base 20, and/or the covered unit 30 with a molar shape.

Figure 1B:
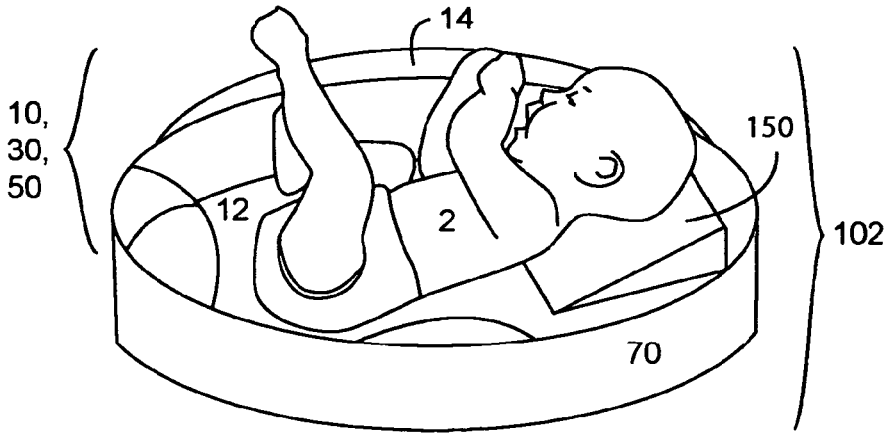
FIG. 1B shows a released baby feeding system holding the baby, after being worn by the wearer, as in FIG. 1A.
Figure 2A:
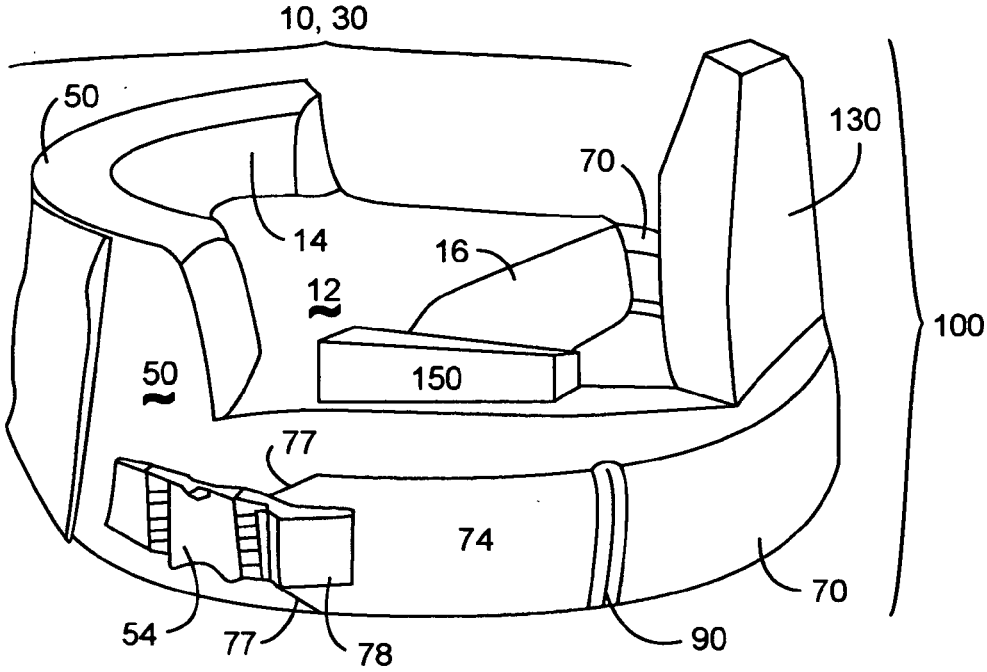
FIG. 2A shows a preferable left side view of the baby feeding systems of FIGS. 1A and 1B.
Figure 2B:
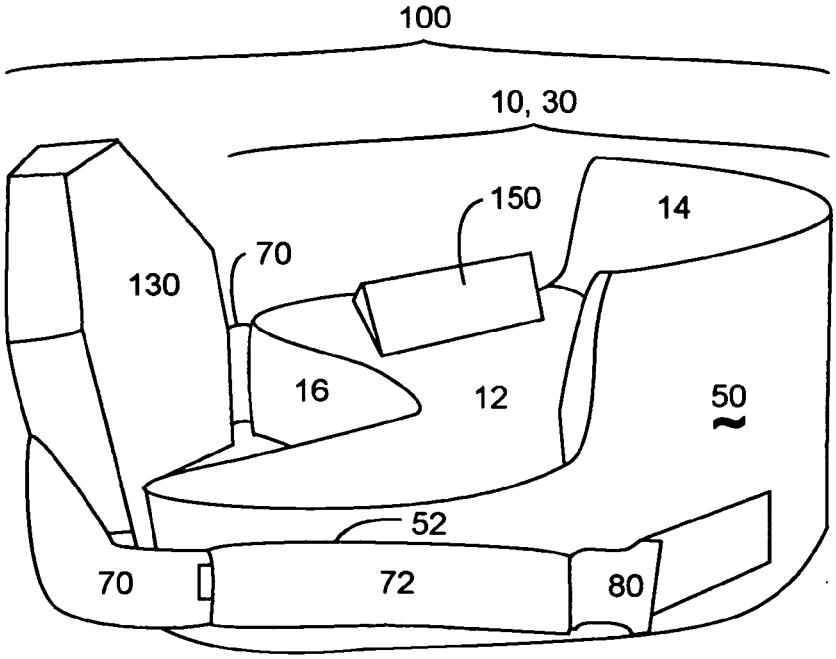
FIG. 2B shows a preferable right side view of the baby feeding systems of FIGS. 1A and 1B.

The ridged base 10 has a ridge 14 with the height of a sufficient magnitude to aid in holding a baby 2 as shown in FIGS. 1A and 1B. The ridged base 10 may further aid in holding adult objects 170 in place, as shown in FIG. 9B.

The ridged base 10 and/or support base 20 each preferably have a width of sufficient magnitude to provide support for the elbow and forearm of the wearer 6 collectively shown in FIGS. 1A, and 9A to 9C.

FIG. 5A shows a baby feeding system 100 including a refinement of the covered unit 30 including a refinement to the ridged base 10 of FIGS. 1A to 3B, including multiple ridges 14A, 14B and 14C, and a platform zone 12 include multiple platform inserts 12A and 12B. FIG. 5B shows a top view of the ridged base 10 of FIG. 5A with a ridge insert 60A capable of insertion into at least one of the platform inserts 12A and/or 12B.

As in FIGS. 5A and 5B, the horseshoe shape of the covered unit 30 may preferably support a woman 6 breast feeding twins more easily in the football hold. Mothers 6 need to use football hold to nurse babies from different positions to drain their breasts completely, without losing back support. This is important for satiety of the baby and the mother's health. It prevents breasts infections in the mother. Some prior art feeding systems require turning the system as a whole to nurse in football hold, often causing the mother to lose back support.

The baby feeding system 100 of FIGS. 5A and 5B may preferably support the nursing of twins. The baby feeding system 100 may preferably have the ends squared off to take advantage of all the surface. Such baby feeding systems 100 may have a width between 21 to about 31 inches. The same types of foam may preferably be used in preferably the same proportions as for the baby feeding systems 100 for a single baby 2. These baby feeding systems 100, which are designed specifically for twin babies, may or may not include a belt 70 or have belt attaching devices on its separable cover 50.

The width of the baby feeding system 100 and/or 200 is at least fifteen inches. Preferably the width is between 18 inches and about 21 inches. The baby feeding systems with this width fit into most rocking and nursing chairs. Nursing chairs often vary in width from 17 to 23 inches. Experiments have shown that baby feeding system of 20 inch width can be successfully compressed to fit into smaller chairs, which may have a width of 18 inch. The width may further be greater than 14 inches.

The invention includes a baby feeding system 100 with a separable cover 50 attaching to a belt 70. The invention also includes the belt 70 for use with baby feeding systems 100. The belt 70 has two ends, a first end 72 and a second end 74. The first end 72 may include a hook and loop strip 76 for coupling to a hook and loop zone 52 on the separable 50. The second end 74 may includes a first quiet clip component 78 to attach to at least one of a second quiet clip component 54. The second, quiet clip components 54 are affixed to the separable cover 50.

As used herein, a hook and loop strip 76 attaches to a hook and loop zone 52 to flexibly bind the two together. An example of hook and loop strips and zones can be found in the commonly available VELCRO™ products.

A sturdy fastening mechanism can be attached to both ends of the support base 20, including a belt 70 adjusted to make the baby feeding system 100 fit securely around the waist of the wearer 6. The belt 70 may preferably attach to a separable cover 50, enclosing the support base 20. The belt 70 may provide adequate thickness and durability to hold the baby feeding system 100 in place when the wearer 6 moves or stands. The belt 70 may preferably be sized to pass snuggly through a back support 130.

Preferably, the snug sizing of the belt 70 through the back support 130 holds it in place, providing stable orthopedic support for the wearer 6. When the wearer 6 places the support base 20 and the ridged base 10 on the side of her waist the back support 130 can be repositioned on the belt 70 to provide full support of the back of the wearer 6. This is often needed when nursing the baby 2 in the football hold position. The back support 130 may preferably have a hexagon shape, which may provide support across the lumbar and dorsal regions of the back and vertically up to the scapulas of the wearer 6. This preferably allows the wearer 6 to freely move his or her arms.

Figure 6A:
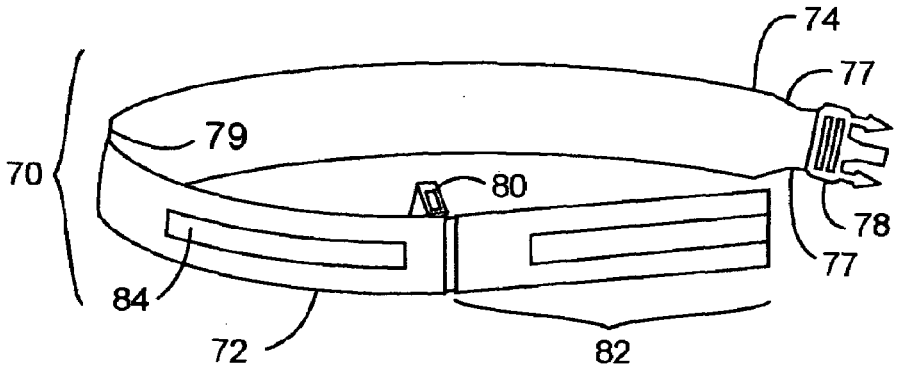
FIG. 6A shows a preferred embodiment of the belt of FIGS. 1A to 3A, and 5A.
Figure 6B:
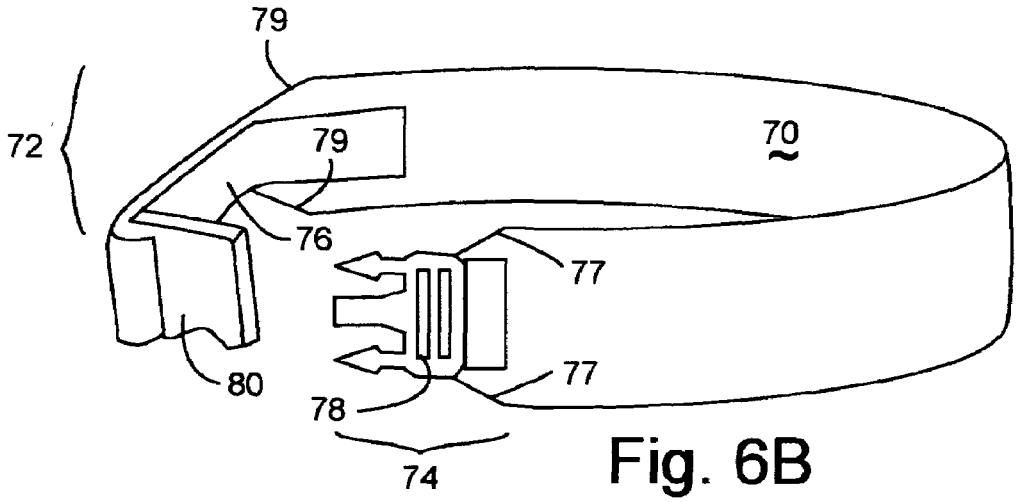
FIG. 6B shows the belt of FIG. 6A adjusted to a length.

FIG. 6A shows a preferred embodiment of the belt 70 of FIGS. 1A to 3A, and 5A. FIG. 6B shows the belt 70 of FIG. 6A adjusted to a length.

The belt 70 may attach to the separable cover 50 through a combination of hook and loop, release buckles, turnlocks, at least one belt loop 90, and/or latches. On one side of the base is a female release buckle. On the corresponding side of the belt 70 is the male release buckle. The belt loop 90 may be located 3 to 10 inches back on the cover. This side of the belt 70 is not adjustable, but rather is extremely secure, holding the pillow in place on the body, as a result of the release buckle and the belt loop 90.

The side of the belt 70 that is not adjustable is latched to 25-40% of the base in order to hold the unit securely next to the body. The combination of the release buckle and the belt loop 90 holds the belt 70 in place and keeps it from slipping and sagging.

The other end of the belt 70 has a hook and loop side, which preferably attaches to at least about 25% and at most about 40% of the base in order to hold the pillow in place securely on the body. The length of this end of the belt 70 extends beyond the hook and loop fastener on the cover. The purpose of this additional length is so that larger wearers 6 can use the baby feeding system 100. A major complaint about some of the prior art baby feeding systems is that they require a 24 inch waist to use, which is too small for larger women 6 and/or uncomfortable for those who just had C-Sections. Women who have had C-sections usually cannot have a tight system around the waist.

The belt 70 on the hook and loop end is adjustable. It can be pulled through the female end of the release buckle. This is where a woman 6 can adjust it to fit around her waist and set it flexibly firmly in place close to her body. These adjustments are done at the beginning of the nursing session when the baby is awake; hence attaching the hook and loop won't disturb the baby.

The belt 70 may be worn in combination with the back support 130 or alone by the wearer 6. The first end 72 preferably has a female release buckle 80. A second end 74 of the belt 70 preferably has a male release buckle 78. The belt 70 can be adjusted through the first end 72 of the release buckle 80 to specifically fit the size of the wearer 6. At least one hook and loop zone and/or at least one hook and loop strip and/or at least one attachable pocket can be placed on the belt 70. One skilled in the art will recognize that the placement of male release buckle 78 and female release buckle 80 may be reversed.

The first week after birth when the stomach of the mother 6 is still large, she may prefer to wear the belt 70 and baby feeding system 100 and/or 200 loosely. She 6 may prefer to bring it to proper nursing distance by placing a traditional pillow under the base. The preference may depend on the depth 32 of the support base 20 used in the baby feeding system 100 and/or 200. Not all mothers may have this additional need. No prior art baby feeding system can be brought closer when the mother is in this type of post-delivery condition.

The belt 70 may preferably have a width between 2 and about 4 inches. The belt 70 may include a back support for the wearer 6, even without the back support 130. The belt 70 preferably may be constructed of any combination of fabric, and plastic. By way of example, the plastic included in the belt 70 may include at least any combination of the following: nylon, spongex, rubber, spandex, canvas, polyester web material, polyester cloth, plastic, neoprene, and/or other flexible material. The belt separable cover may preferably include a similar soft and/or durable material as the separable cover 50 for the baby feeding system 100. The thickness of the belt 70 may preferably range from 1/16 to 5/16 of an inch. Some belt 70 separable covers may be made of a flame retardant cotton. Some belt 70 separable covers may be preferably made of non-flame retardant cotton. Some belt 70 separable covers may preferably be made of vinyl.

The belt 70 can also be attached to a back support 130. The belt 70 itself passes through a pocket on the back support 130. The back support 130 can be shifted in its placement on the belt, allowing for precise placement on the back of the wearer 6.

The belt 70 can be surface cleaned or hand washed.

The belt 70 preferably allows the nursing mother 6 to adjust the fit of the baby feeding system 100 as her waist begins its post-partum reduction in size. This is important for mothers recovering from a Cesarean-section delivery.

The belt 70 may preferably be worn around the back portion of the waist of the wearer 6 as shown in FIG. 1A. The belt 70 may also be worn along the side of the wearer 6.

The belt 70 is preferably made of a resilient material to support the shape of the covered unit 30 worn on the other side of the waist of the wearer 6. The belt 70 is preferably form fitting to allow for the precise placement of a back support 130 of sufficient size and width behind the back of the wearer 6.

Preferably, the belt 70 can be adjusted to make the baby feeding system 100 and/or 200 and/or covered unit 30 of FIGS. 1A to 3B, 5A, and 5B, fit snuggly around the waist of the wearer 6 as shown in FIGS. 1A, and 9A to 9D.

The belt 70 is preferably of adequate thickness and durability to hold covered units 30 in place and is sized to pass snuggly through a back support 130 to support the back of the wearer 6 as shown in FIGS. 1A, 9A, 9C and 9D. This may be true when the wearer moves and/or stands, in addition to sits, as shown in FIGS. 1A, 9A, 9C and 9D.

Preferably, the belt 70 can fit different sized wearers 6. Preferably the fit of the belt 70 for a particular wearer 6 can be more or less tight. The support base 20 is shaped in a semicircle 16 to preferably fit closely to the waist of the wearer 6. At least one fastening mechanism of sturdy construction can be attached to both ends 52 and/or 54 of the separable cover 50 over the covered unit 30.

Fasteners 54 and 52 on the separable cover 50 collectively shown in FIGS. 1A, 2A, 2B, and 8A to 8E may include, but are not limited to, hook and loop, release buckles, turnlocks, snaps, belt loops, and/or latches. Preferably at least one of the fasteners 52 and/or 54 will be hook and loop free so that when the baby 2 falls asleep, the baby feeding system 100 and/or 200 can be removed without waking the baby 2.

Another feature unique to the baby feeding system of this invention is that the belt 70 and back support 130 can be worn independently from the base and attachable pillows. That is, when only back support is required, such as when driving, watching television, or riding in a plane the surface pillows worn on the lap can be removed giving the wearer more space for movement. The belt 70 may be sold in at least two sizes, and the wearer 6 or their associate may select a size optimized for their waist or situation. The situation may include, but is not limited to, a recent C-section during the birth process.

As used herein, a hook and loop strip attaches to a hook and loop zone to flexible bind the two together. An example of hook and loop strips and zones can be found in the commonly available VELCRO™ products.

Putting a hook and loop fastener on one side, preferably 52, but possibly 54, of a baby feeding system 100 allows the mother 6 to adjust system and the belt 70 to fit around the waist when she begins to nurse the baby 2. The system 100 has benefit of hook and loop on one side, preferably 52 of the separable cover 50, for good adjustment around the waist of the mother 6. There is also a benefit of a latch composed of quiet clip components on both sides. The side 52 and/or 54 with only a latch can be opened when the baby 2 is finished with nursing without waking the baby.

The hook and loop 52 on separable cover 50 is preferably of sufficient width, length, and strength to make the baby feeding system 100 and/or 200 securely held in place. A major complaint about some prior art baby feeding systems is that they do not stay secure around the waist. The quiet clip components form a latch on at least one side, which is preferably of sufficient strength to hold the baby feeding system 100 or 200 securely in place.

The length of the hook and loop 52 on the separable cover 50 preferably allows small to large women to use the baby feeding system 100. A complaint about some prior art baby feeding systems is that they require too small a waist for many women, especially women who just had a baby. Tightness adjustment is also important for women 6 who had C-sections.

For the large base unit specifically designed for nursing twins, the matching back support 130 may or may not be loose and may or may not be attached through a belt.

The method of using the belt 70 includes the following. The belt 70 is adjustably fastened by the first hook and loop zone 76 coupling with the hook and loop zone 52, preferably after going around a person 6 wearing the system 100, respectively. The belt 70 is fastened by the first quiet clip component 78 attaching to the second quiet clip component 54. These steps are typically performed when a baby is about to nurse and awake. A worn version 110 of the baby feeding system 100 is the product of the use of the belt 70.

When the baby 2 has fed and drifted into sleep, the belt 70 is further used to release the first quiet clip component 78 and second quiet clip component 54 without tending to wake the baby 2. This allows the person 6 wearing the system 100 to remove it and create a released baby feeding system 102. The released baby feeding system 102 is a product of this process. It has the advantage of not disturbing the sleep of the baby 6 when created. FIG. 1B show a released baby system 102 holding the baby 2, after being worn by the wearer 6, as in FIG. 1A.

Figure 12A:
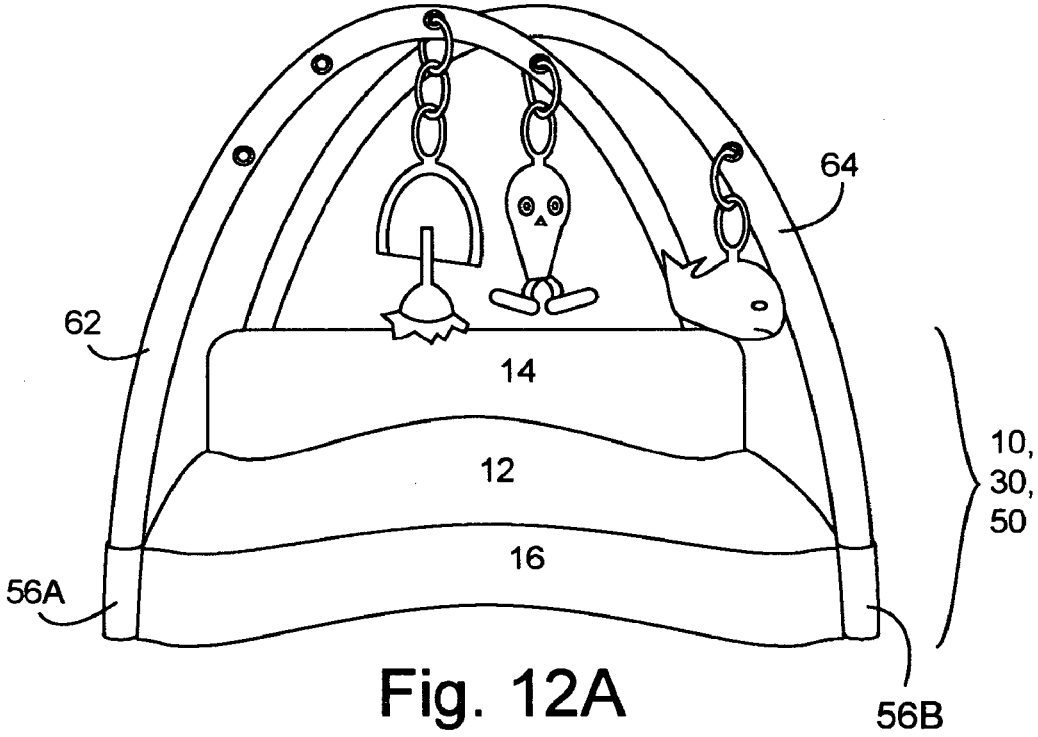
FIGS. 12A and 12B show the separable cover with pole holders for poles.
Figure 12B:
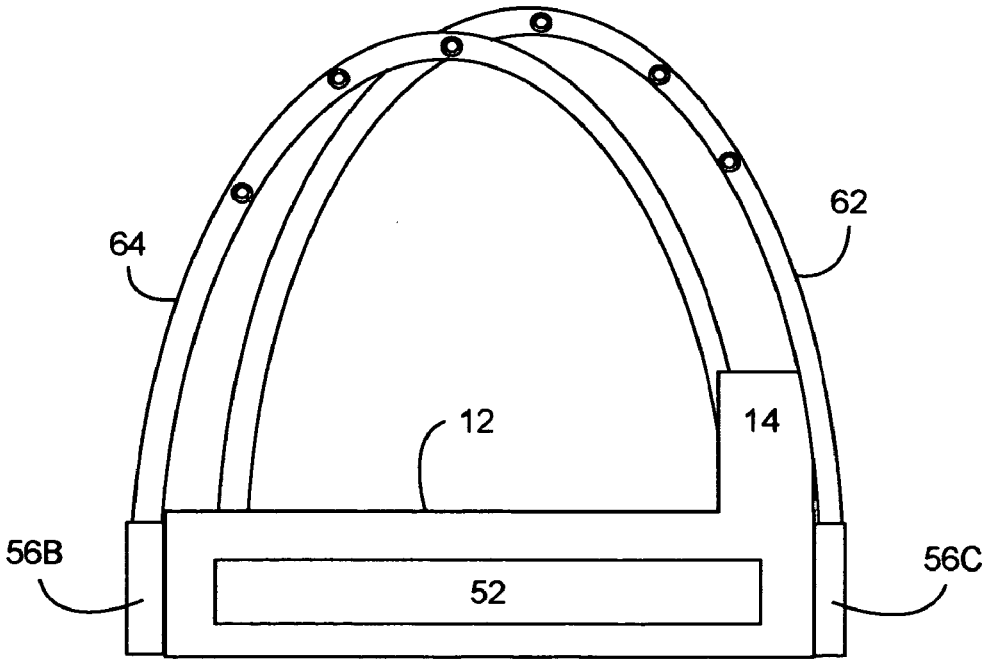

The ridged base 10 of FIGS. 1A, 2A to 5B can also be used as a pillow to support a baby 2 learning to sit up, providing a support device for babies to sit up. Later on, toddlers can sit on the base or use it as doll furniture. The ridged base 10 may preferably be used by attaching four holders 56A to 56D to separable cover 50, partly shown in FIGS. 12A and 12B for poles 62 and 64, to attach toys. The base may be used with babies 2 who may be sitting up or lying down. In certain preferred embodiments the support base 20 may be separated for older babies and toddlers. The separable cover 50 may further, often preferably, include loops as holders 56A to 56D for the poles 62 and 64. The loops may further preferably be attached to the bottom portion of the separable cover 50. One skilled in the art will recognize that holder 56D, while not shown, is preferably situated in a fashion similar to holder 56C of FIG. 12B, toward the back side of the separable cover 50, opposite holder 56B on the front.

FIG. 4A shows a top view an embodiment of the baby feeding system 200 including the ridged base 10 with an attached closure arm 202, collectively covered by a separable cover 50 with removal zipper 36 located below the covered unit 30 for holding the baby 6.

The baby feeding system 100 of FIGS. 1A to 3B, 5A, and 5B preferably includes a separable cover 50. The separable cover 50 includes a removal zipper 36 located below the covered unit 30 for holding the baby 6 as shown in FIG. 4A.

The removal zipper 36 of the separable cover 50 used with the baby feeding systems 100 preferable extends for at least M percent of the outside perimeter 34 from near the joint side 38. The joint side 38 refers the location on the outside perimeter 34 of the underside of the separable cover 50 nearest to the joining of at least the support base 20 and the belt 70. This can be seen as being near one of the ends 52 and 54, upon which quiet clip components and/or hook and loop zones. With regards to the separable covers 50, these baby feeding systems 200 may or may not include the ridge 10. M is preferably at least 75 percent. M is further preferably at least 85 percent. M is further preferably at least 90 percent. M is further preferably at least 95 percent.

The advantage that placing the removal zipper 3 near the joint side 38 and extending it M percent of the outside perimeter 34 is that the separable cover 50 becomes easy to remove. The separable cover 50 has the advantage of being easy to remove and replace, which eases the task of cleanup. Cleanup tasks are one of the major chores of baby care.

The removal zipper 36 of the separable cover 50 used with the baby feeding systems 200 preferably extends at least N percent of the outside perimeter 34. N is at least 90 percent. The separable cover has the advantage of being easy to remove and replace, which eases the task of cleanup. Cleanup tasks are one of the major chores of baby care. N may further preferred to be at least 95 percent. N may further be preferred to be at least 98 percent.

All embodiments of the separable covers 50 include a removal zipper 36. The separable cover 50 may preferably include a fabric. The fabric is preferably primarily composed of a cotton, sturdy, and washable. The fabric may be primarily composed of a vinyl for use in health/public institutions. The fabric may preferably include a fabric protector. In certain preferred embodiments, the fabric does not contain any flame retardants. In certain alternative preferred embodiments, the fabric does contain at least one flame retardant. The flame retardant may further be preferred to be required to children's clothing and/or bedding by an agency of a government. The government may be a nation, state, province, country or city. By way of example, the state may be within the United States of America, or Mexico. The province may be a province of Canada, Spain or France. The county may be a county in Great Britain, Ireland, or Scotland.

The separable cover 50 preferably covers a covered unit 30 including the ridge base 10 and the support base 20. The separable cover 50 is preferably washable, and may cover just the support base 20 as shown in FIG. 8B. The baby feeding system 100 may also preferably include a separable cover for the back support 130.

The separable cover 50 can be made to fit the support base 20 alone as in FIGS. 8B, 9A and 9C. There may be at least one pocket for holding a bottle or burp cloth, a cell phone, or other small items on the separable cover similar to the pocket shown in FIGS. 1A and 2A. The separable cover 50 may also include the attachable spots/places for the belt 70 and possibly the back support 130.

Figure 8C:
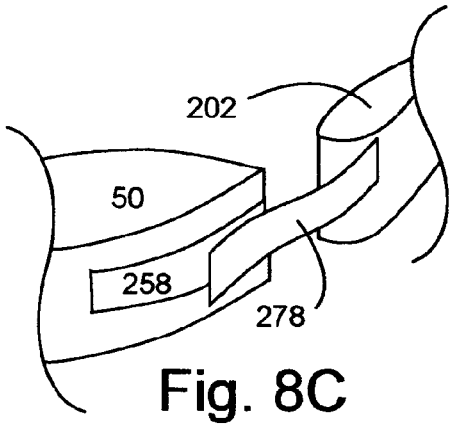
FIGS. 8C to 8E shows some examples of couplings with the separable cover collectively found in FIGS. 1A to 3A, 5A, 6A, 6B, 8A and 8B.
Figure 8D:
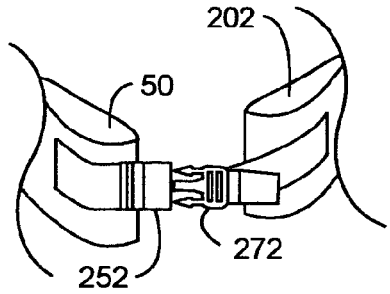
Figure 8E:
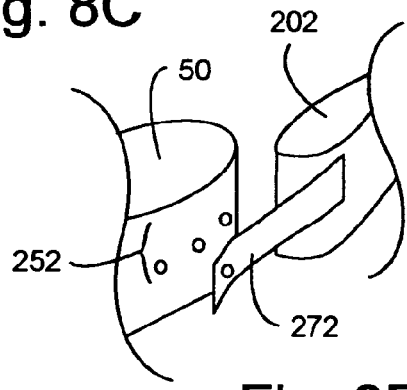

FIGS. 8C to 8E shows some examples of the coupling 278 with the separable cover 50 collectively found in FIGS. 4A, 4B and 8A.

Figure 6C:
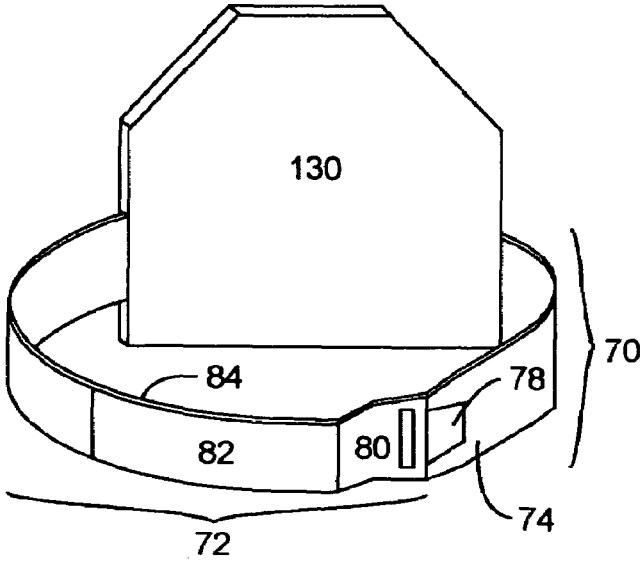
FIG. 6C shows the belt of FIG. 6B using the back support of FIGS. 1A, 2A, 2B 3A, and 5A.

FIGS. 7A and 7B show two views of embodiments of the back support 130 of FIGS. 1A, 2A, 2B, 3A, 5A, and 6C, with multiple sizes and shapes. The invention includes a collection of back supports 130 of varying sizes and shapes labeled 130-A to 130-E in FIGS. 7A and 7B. At least one of the sizes 130-A relieve back pain for large women. At least one of the sizes 130-B relieve back pain for smaller women. At least one of the sizes 130-C relieve back pain for petite women. The back supports 130-A to 130-E preferably include a pocket 140 through which the belt 70 may pass.

Preferably, the belt 70 and back support 130 used with the ridged base 10 shown in FIGS. 1A, 2A to 3A, and 5A, may also be used with the support base 20 alone, as shown in FIGS. 8B and 9C.

The baby feeding system 100 also provides back support for the wearer 6. Specifically, the belt 70 and back support 130 provide for the lumbar and dorsal regions of the back of the wearer 6 as shown in FIG. 9A. The back belt 70 and back support 130 preferably provide support for the lumbar and dorsal regions of the back, up to the deltoids of the wearer 6. The belt 70 and the back support 130 help to position the wearer 6 in an orthopedically correct position, thereby reducing strain on the back. Prior art units tend to only support the lumbar region of the back.

The baby feeding system 100 according to the invention is the first pillow system that provides support of the back, but that can be adjusted to support the back with equal success when the wearer 6 is nursing the baby 2 in the cradle, cross cradle, or football hold positions.

A back support 130 may preferably be primarily composed of a medium firm foam. This tends to give flexibly firm yet resilient support. The thickness of the back support 130 can range from 1 to 2 inches. The shape of the back support 130 is an irregular hexagon—that is, it has six sides, but they are not of equal length as shown in various embodiments 130-A to 130-E in FIGS. 7A and 7B. The bottom 3 sides of the base support pillow are longer than the top 3 sides. The top 3 sides are cut thinner (less thick) to fit correctly into the deltoid muscles.

The back support 130 may be selected from a collection of various heights and widths to properly fit wearers 6 with different sized backs. The tallest version preferably extends support up to the deltoids as shown in FIG. 9A. Ranges in width of the widest horizontal part of a back support 130 may preferably be between 10 inches to 14 inches. The height of back support 130 may preferably be between 8 inches to 13 inches. Wearers 6 can chose back support 130 of best size to fit them. Some prior art baby feeding systems required that exactly one back support fit all wearers.

In another version to match the large twin baby feeding system 100 as in FIGS. 5A and 5B, the back support 130 may have three straight sides and a top rounded side, providing more surface space for support. This may help to keep the back support 130 from slipping.

FIG. 6C shows the belt 70 of FIG. 6B using the back support 130 of FIGS. 1A, 2A, 2B, 3A, and 5A.

FIG. 8B shows the belt 70 with the back support 130 attached to a separable cover 50 covering the support base 20, collectively found in FIGS. 1A to 3B, 5A, and 6A to 7C.

FIG. 9A shows the back view of the baby feeding system 100 with the belt 70 and the back support 130 collectively found in FIGS. 1A, 2A to 3A, 6C to 7B, and 8B, used by a wearer 6 to support their arms.

The belt 70 may be inserted through the pocket 140 of a back support 130. The belt 70 may then create a worn version of the baby feeding system 100 with a selectable back support 130 as shown in FIG. 1A. The worn version of the baby feeding system 100 with the selectable back support is a product of this process.

Figure 9D:
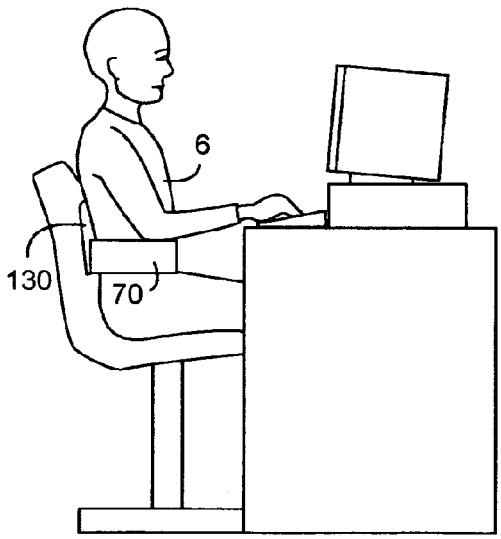
FIG. 9D shows the wearer using the belt holding the back support, collectively found in FIGS. 6A to 7B.

The pocket 140 preferably faces away from the wearer 6 when used with the belt 70. The belt 70 may further include a second, quiet clip component 80 situated near the first end of the belt 72. The belt 70 and back support 130 provide a portable back support attached by the belt 70 to the wearer 6 as shown in FIG. 9D.

The separable cover 50 for the back support 130 may preferably have at least one pocket 140 through which the back belt 70 passes as in FIG. 3A. The back support 130 may not have the pocket 140.

As stated above the back support 130 can be attached to the belt 70 through the pocket 140 that is sewn onto the cover of the back support 130. Thus, the back support 130 is optional. Some nursing mothers 6 like these built in devices, whereas other wearers 6 do not. A complaint about prior art baby feeding systems is that some mothers 6 found back supports in the way and uncomfortable because they actually cause the mother 6 to hunch over.

The belt 70 may be inserted through the pocket 140 of one of the back supports 130-A to 130-E. The belt 70 may be used to create a worn version 110 of the baby feeding system 100 with a chosen back support 130 as shown in FIGS. 1A and 9B. The worn version 110 of the baby feeding system 100 with the chosen back support 520 is a product of this process, which will be discussed regarding FIG. 10.

FIG. 9D shows the wearer 6 using the belt 70 holding the back support 130, collectively found in FIGS. 6C to 7B.

FIG. 9A shows the back view of the baby feeding system 100 with the belt 70 and the back support 130 collectively found in FIGS. 1A, 2A to 3A, 5A, 6C to 7B, and 8B, used by a wearer 6 to support their arms.

FIG. 9B shows a perspective view of the wearer 6 using the baby feeding system 100 of FIGS. 1A to 3A, and 4A to 5B, to at lease partly hold an adult item 170, such as a book. The baby feeding system 100 and/or 200 may also provide a portable shelf with a ridge 14 upon which adult items 170 may be placed as shown in FIG. 9B. Adult items 170 may include, but are not limited to, a book, cosmetics, a personal digital assistant or notebook computer. The ridge 14 limits the opportunities for adult items 170 to fall off the portable shelf 12.

The baby feeding system 100 and/or 200 can support the arms whenever arms work in close proximity to the body is required, such as typing on a keyboard, knitting, playing cards, reading as shown in FIGS. 9A and 9C. Big kids can use it to play video games. The baby feeding system 100 also supports and holds objects in close proximity to the body of the wearer 6 as shown in FIG. 9B. The invention may also be used to free up the wearer's 6 hands while reading.

The support base 20 may also support the wearer's 6 forearms while typing on a keyboard or eating as shown in FIG. 9C.

The ridged base 10 may also be made with an attached back support arm 202 as shown in FIGS. 4A and 4B, instead of using the belt 70 of FIGS. 1A, 2A, 2B, 3A, and 5A. The ridged base 10 shown in FIG. 4B may also be made with an attached back support 204 as part of the attached arm 202.

FIG. 8A shows a detail of the attached closure arm 202 of the baby feeding system 200 of FIG. 4B. FIG. 4B shows a front view of an alternative embodiment of the baby feeding system 200 of FIG. 4A where the attached closure arm 202 includes a back support 204.

The support base 20 can be used alone when the baby 2 outgrows the ridged base 10. FIG. 9C shows the wearer 6 using the support base 20 with a separable cover 50, coupled with a belt 70 holding the back support 130, collectively found in FIGS. 6A to 7B, 8B to 8E and 9A.

The ridged base 10 may preferably be removed from the support base 20, leaving an open, semicircle surface as shown in FIGS. 3B and 8B. The support base 20 preferably has a front width of sufficient magnitude to enable support of larger objects that may not require to be held in place by the hands of the wearer 6, or to be held in place for long periods of time. By way of example, the support base 20 provides ample room for a mother 6 to nurse an older baby 2 or toddler. The wearer 6 may place a keyboard or food tray, yet it is also shaped and constructed to support the elbows and forearms of the wearer.

In another embodiment, the support base 20 can be worn independently from the ridged base 10 around the waist of the wearer 6 as in FIGS. 8B, 9A and 9C.

The baby feeding system 100 may further include the wedge-shaped pillow 150. The wedge-shaped pillow 150 preferably includes a washable cover.

The wedge-shaped pillow 150 may be inserted between the head and neck area of the baby 2 and the platform zone 12 as collectively shown in FIGS. 1A and 1B. The wedge-shaped pillow 150 is moveable. The baby 2 is supported with his head above his stomach regardless of which side he is nursing. This is true when nursing in the cradle hold positions, or when the baby 2 is being nursed in the football hold position. The wedge-shaped pillow 150 can easily be removed when the baby 2 is resting in the supine position.

The structural support rendered by the ridge 14 and the wedge-shaped body 150 results in the body of the nursing infant 2 being properly positioned on his or her side while nursing in the cradle-hold and cross-cradle hold positions and with his or her head adequately elevated above the stomach. This combination of supporting structures included in the baby feeding system 100 and/or 200 assists the nursing mother 6 with properly latching the baby 2 onto her nipple. The combination also helps the mother 6 holding the baby 2 in the correct position for optimal feeding, while supporting and minimizing the use of the hands by the mother 6.

Figure 10:
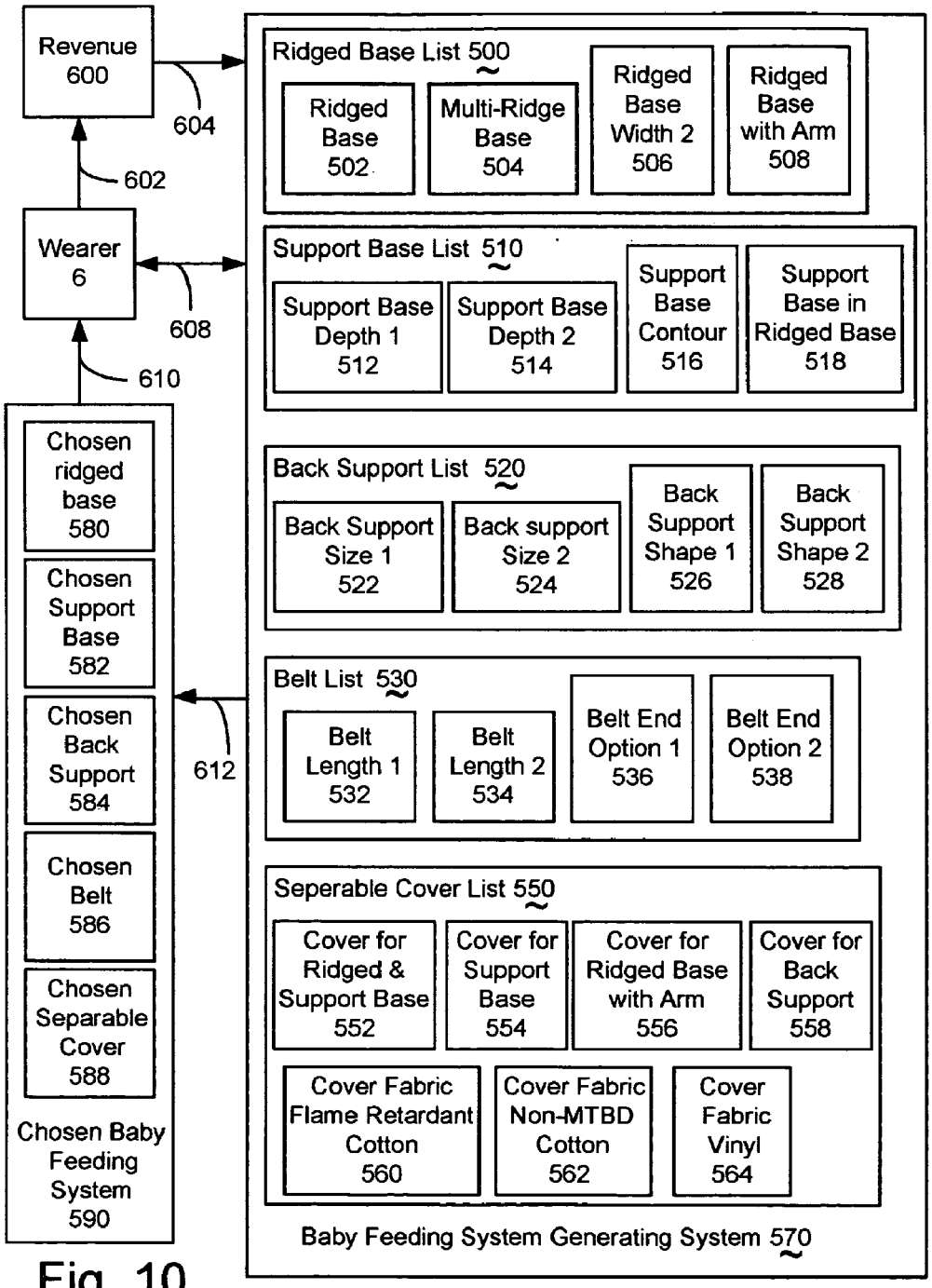
FIG. 10 shows a method of doing business using various embodiments of the invention.

The invention includes a business method based upon a wearer 6, their associate and/or agent selecting components based upon the invention to create a baby feeding system 590 upon committing 602 to pay 604 a revenue 600. The chosen component(s) 580 to 588 and/or chosen baby feeding system 590 are products of the business method, as is the revenue 600. FIG. 10 shows a method and system for doing business using at least one embodiment of the invention shown in the previous Figures.

In FIG. 10, a system 570 presents 608 at least one member of the following lists to the wearer 6. A ridged base list 500, a support base list 510, a back support list 520, a belt list 530 and/or a separable cover list 550.

In FIG. 10, the presentation 608 may take the form of an interaction with printed matter presenting the member(s) of the lists 500, 510, 520, 530 and/or 550. Alternatively, the presentation 608 may be an acoustic interaction, sometimes referred to as ordering by telephone. Alternatively, the system 570 may include at least one computer, driven by a program system. The program system may include program steps implementing the interactive method.

A computer as used herein will include, but is not limited to, an instruction processor. The instruction processor includes at least one instruction processing element and at least one data processing element, each data processing element controlled by at least one instruction processing element.

In FIG. 10, the interactive method may involve the wearer 6, or an associate of the wearer 6 or an agent of the wearer 6. For the sake of simplicity the wearer 6 is shown in FIG. 10. One skilled in the art will recognize that not only the wearer 6, but also someone associated with the wearer 6, or an agent of the wearer 6 may interact 608 with the presentations, commit 602 revenue 600 for payment 604. These actions lead to the delivery 61 of at least one element of the chosen baby feeding system 590, which may be used 610 by the wearer 6.

In FIG. 10, the wearer 6 selects at least one version of a member of at least one of the lists 500, 510, 520, 530, and/or 550. The wearer 6 commits 602 to providing a revenue 600 sent 604 to the system 570. The system 570 provides 612 at least one of the chosen components to be delivered 610 to the wearer 6.

In FIG. 10, the chosen components may include any combination of at least one of the following:

A chosen ridged base 580, based upon the ridged base list 500.

A chosen support base 582, based upon the support base list 510.

A chosen back support 584, based upon the back support list 520.

A chosen belt 586, base upon the belt list 530.

A chosen separable cover 588, based upon the separable cover list 550.

A chosen baby feeding system 590, including at least one of the chosen components, 580 to 588.

As used herein, presenting an item or version of an item may include, but is not limited to, providing a mechanism by which the wearer 6 may chose that item or version.

In FIG. 10, presenting the ridge base list 500 may include any combination of the following.

Presenting at least one version 502 of a ridged base 10 as shown in FIGS. 1A to 3B, 8A and 9B.

Presenting at least one version 504 of a multi-ridged base as shown in FIGS. 5A to 5B.

Presenting at least one version 506 of a ridged base of a second width, which by way of example may be 23 inches. The version(s) 502 of the ridged base 10 may be at least 15 inches of width. The version(s) 502 of the ridged base 10 may further be 18 inches of width.

Presenting at least one version 508 of a ridged base 10 with an attached arm 200 as shown in FIGS. 4A and/or 4B.

In FIG. 10, presenting the support base list 510 may include any combination of the following.

Presenting at least one version 512 of a support base 20 of a first depth. The support base 20 is shown in FIGS. 3B, 7C to 7E and 8B. The first depth, by way of example, may be about 3 inches as shown in FIG. 7E.

Presenting at least one version 514 of a support base 20 of a second depth, by way of further example, may be about 6 inches and shown in FIG. 7C.

Presenting at least one version 516 of a support base 20 for a second contour, which by way of example, may be shown in FIGS. 5A and 5B.

Presenting at least one version 518 of a support base 20 in a ridged base 10, which by way of example, may be shown in at least one of the FIGS. 3A, and 4A to 5B.

In FIG. 10, presenting the back support list 520 may include any combination of the following.

Presenting at least one version 522 of a back support 130 of a first size. By way of example, the first size may be shown in FIGS. 7A and 7B with the back support 130-A. The back support 130 is shown in FIGS. 1A, 2A to 3A, 5A, 6C to 7B, 8B, 9A, 9C and 9D.

Presenting at least one version 524 of a back support 130 of a second size. By way of example, the second size may be shown in FIGS. 7A and 7B with the back support 130-C.

Presenting at least one version 526 of a back support 130 of a first shape. By way of example, the first shape may be shown in FIGS. 7A and 7B with the back support 130-D.

Presenting at least one version 528 of a back support of a second shape. By way of example, the second shape may be shown in FIGS. 7A and 7B with the back support 130-E.

In FIG. 10, presenting the belt list 530 may include any combination of the following.

Presenting at least one version 532 of the belt 70 of a first length, which by way of example accommodated a wearer 6 with a waist up to 28 inches. The belt 70 is shown in FIGS. 1A to 3A, 6A to 7B, 8B to 8E, 9C and 9D.

Presenting at least one version 534 of a belt of a second length, which by way of example, accommodates a wearer 6 with a waist up to 42 inches.

Presenting at least one version 536 of a belt with a first option for at least one of the belt ends. By way of example, the first option for belt ends may be shown in FIGS. 2A, 2B, and 6A to 6C.

Presenting at least one version 538 of a belt with a second option for at least one of the belt ends. By way of example, the second option may include a variant of the belt ends shown in FIGS. 8C to 8E.

In FIG. 10, presenting the separable cover list 550 may include any combination of the following.

Presenting at least one version 552 of a separable cover 50 for a covered unit 30 including a ridged base 20 and possibly a support base 10, as shown in FIGS. 1A to 3A, and 5A.

Presenting at least one version 554 of a separable cover 50 for a covered unit 30 with just a support base 20 as shown in FIG. 8B.

Presenting at least one version 556 of a separable cover for covered unit 30 including just a ridged base 10 with an attached arm 202 as shown in FIGS. 4A and 4B.

Presenting at least one version 558 of a separable cover for a back support 130 as shown in FIGS. 1A, 2A to 3A, 5A, 6C to 7B, 8B, 9A, 9B and 9C.

Presenting at least one version 560 of the separable cover 50 is made from a flame retardant cotton.

Presenting at least one version 562 of the separable cover 50 is made from a non-PBDE cotton Presenting at least one version 564 of the separable cover 50 is made from a vinyl fabric.

The preceding embodiments have been provided by way of example and are not meant to constrain the scope of the following claims.

What is claimed is:

1. A lap pad for aiding a mother in nursing an infant, comprising:

a ridged base having a platform zone, a perimeter and an indentation along a portion of the perimeter operably configured to fit against the mother when the device is in use;

a ridge removably disposed on the ridged base along the perimeter, wherein the ridge does not extend along the indentation; and, wherein the platform zone is substantially defined between the ridge and the indentation on the ridged base and when in use, the infant is retained substantially on the platform zone between the mother and the ridge.

2. The lap pad, as recited in claim 1, further comprising:

a support base having a support base perimeter and an indentation alone the support base perimeter and a shape similar the indentation of the ridged base, the support base being disposed adjacent to the ridged base on a surface opposite from the platform zone;

a separable cover for the support base, the ridged base and the ridge, the separable cover having a zipper, and a belt, wherein the belt includes a first end having a hook strip for coupling to a loop zone on the separable cover; and a second end including a first clip component operably configured to attach to a second clip component affixed to the separable cover.

3. The lap pad, as recited in claim 2, wherein the belt includes a lumbar support.

4. The lap pad, as recited in claim 2, wherein the separable cover includes pockets operably configured to hold objects.

5. The lap pad, as recited in claim 2, wherein the separable cover includes poles and loops operably configured to hold the poles.

6. The lap pad, as recited in claim 2, wherein the ridged base is held to the support base with hook and loop fasteners.

7. The lap pad, as recited in claim 1, further comprising a closure arm having a first end and a second end, wherein the first end is disposed on the support base along the perimeter next to the indentation and the second end is operably configured to wrap around the back of the mother when in use.

8. The lap pad, as recited in claim 7, further including a male and female fastener, wherein at least one of the male and female fastener is disposed on the second end of the closure arm and the remain end is disposed on the support base along the perimeter.

9. The lap pad, as recited in claim 1, wherein the ridged base are constructed of flexibly firm foam.

10. The lap pad, as recited in claim 1, wherein the ridge includes at least one removable portion creating a gap in the ridge along the perimeter of the ridged base.

11. The lap pad, as recited in claim 1, wherein the ridge is disposed on the ridged base using hook and loop fasteners.

12. The lap pad, as recited in claim 1, wherein the ridged base has a first and second surface and a thickness defined between the first and second surfaces, the thickness is graduated starting from the indentation with the platform zone being inclined toward the indentation.

13. A lap pillow device for supporting items on a user's lap, comprising:

a support base having a perimeter and an indentation along a portion of the perimeter operably configured to fit against the user, when the device is in use;

a closure arm having a first end and a second end, wherein the first end is disposed on the support base along the perimeter next to the indentation and the second end is operably configured to wrap around the back of the user when in use;

a ridged base having a perimeter, an indentation along a portion of the permeter being aligned with and having a shape similar to the indentation of the support base, a first surface and a second surface, and a platform zone disposed on the first surface, and the second surface is removably disposed on the support base;

a ridge removably disposed on the ridged base along the perimeter, wherein the ridge does not extend long the indentation of the ridged base, perimeter, and wherein the ridge includes at least one removable portion creating a gap in the ridge; and, wherein the platform zone is substantially defined between the ridge and the indentation on the ridged base, and wherein the ridged base has a thickness defined between the first and second surfaces, the thickness is graduated starting from the indentation with the platform zone being inclined toward the indentation, and when in use, the item is retained substantially on the platform zone between the user and the ridge.

14. The lap pad, as recited in claim 1, further comprising a closure arm having a first end and a second end, wherein the first end is disposed on the ridged base along the perimeter next to the indentation and the second end is operably configured to wrap around the back of the mother when in use.

15. The lap pillow device, as recited in claim 13, further comprising a separable cover for the support base, the closure arm, the ridged base and the ridge having a zipper, and a belt disposed on the closure arm, wherein the belt includes a first end having a hook strip for coupling to a loop zone on the separable cover; and a second end including a first clip component operably configured to attach to a second clip component affixed to the separable cover.

16. The lap pillow device, as recited in claim 15, wherein the belt includes a lumbar support.

17. The lap pillow device, as recited in claim 15, wherein the separable cover includes pockets operably configured to hold objects.

18. A nursing pillow for aiding a mother in nursing an infant, comprising:

a support base having a perimeter and an indentation along a portion of the perimeter operably configured to fit against the mother, when the device is in use;

a ridged base having a perimeter identical to the support base including a same shaped indentation, a first surface and a second surface, and a platform zone disposed on the first surface, and the second surface is removably disposed on the support base;

a ridge removably disposed on the ridged base along the perimeter, wherein the ridge does not extend completely around the perimeter, further wherein the ridge includes at least one removable portion creating a gap in the ridge along the perimeter of the ridged base;

a separable cover for the support base, the ridged base and the ridge having a zipper, and a belt, wherein the belt includes a first end having a hook strip for coupling to a loop zone on the separable cover; and a second end including a first clip component operably configured to attach to a second clip component affixed to the separable cover; and, wherein the platform zone is substantially defined between the ridge and the indentation on the ridged base and when in use, the baby is retained substantially on the platform zone between the mother and the ridge.

19. The nursing pillow, as recited in claim 18, wherein the separable cover includes poles and loops operably configured to hold the poles.

20. The nursing pillow device, as recited in claim 18, wherein the belt includes a lumbar support.

21. The nursing pillow device, as recited in claim 18, wherein the separable cover includes pockets operably configured to hold objects.

* * * * *